US012692694B2

(12) United States Patent
Chen

(10) Patent No.: US 12,692,694 B2
(45) Date of Patent: Jul. 28, 2026

(54) QUICK ASSEMBLED AND DISASSEMBLED SHED

(71) Applicant: Foremost Home Inc., East Hanover, NJ (US)

(72) Inventor: Liang Chou Chen, Taipei City (TW)

(73) Assignee: Foremost Homes Inc., East Hanover, NJ (US)

( * ) Notice: Subject to any disclaimer, the term of this patent is extended or adjusted under 35 U.S.C. 154(b) by 491 days.

(21) Appl. No.: 18/218,204

(22) Filed: Jul. 5, 2023

(65) Prior Publication Data

US 2024/0392556 A1 Nov. 28, 2024

(51) Int. Cl.

| | |
|---|---|
| ***E04B 1/343*** | (2006.01) |
| ***E04B 1/38*** | (2006.01) |
| ***E04B 1/41*** | (2006.01) |
| ***E04B 1/61*** | (2006.01) |

(52) U.S. Cl.

CPC ..... *E04B 1/34321* (2013.01); *E04B 1/388* (2023.08); *E04B 1/612* (2013.01)

(58) Field of Classification Search

CPC ..... E04B 1/34321; E04B 1/388; E04B 1/612
USPC ..... 52/91.3
See application file for complete search history.

(56) References Cited

U.S. PATENT DOCUMENTS

| | | | | |
|---|---|---|---|---|
| 5,657,583 | A * | 8/1997 | Tennant | E04B 1/34321 52/270 |
| 7,877,936 | B2 * | 2/2011 | Uffner | E04B 7/20 52/79.5 |
| 8,020,347 | B2 * | 9/2011 | Mower | E04B 1/34321 52/79.5 |
| 2006/0191209 | A1 * | 8/2006 | Reisman | E04B 1/34315 52/36.2 |
| 2009/0165401 | A1 * | 7/2009 | Smalley, III | E04B 1/34315 52/745.05 |
| 2011/0011010 | A1 * | 1/2011 | Mower | E04B 7/20 52/79.5 |
| 2014/0283464 | A1 * | 9/2014 | Vogler | E04H 5/00 52/79.5 |
| 2014/0311053 | A1 * | 10/2014 | Hartman | E04H 1/005 52/79.5 |
| 2016/0157456 | A1 * | 6/2016 | Volin | A01K 1/0035 119/501 |
| 2020/0165811 | A1 * | 5/2020 | Vita, Jr. | E04B 1/388 |
| 2024/0309632 | A1 * | 9/2024 | Schofield | E04B 1/6116 |
| 2025/0034891 | A1 * | 1/2025 | Jiang | E04H 1/1205 |

* cited by examiner

*Primary Examiner* — James J Buckle, Jr.
(74) *Attorney, Agent, or Firm* — Faegre Drinker Biddle & Reath LLP

(57) ABSTRACT

A fast assembly and disassembly shed comprises multiple prefabricated wall panels, multiple prefabricated roof panels, multiple prefabricated floor panels, and multiple quick assembly connectors. These prefabricated wall panels can be quickly assembled or disassembled to enclose a space. These prefabricated roof panels can be quickly assembled or disassembled onto the upper edge of the prefabricated wall panels to cover the space. These prefabricated floor panels can be quickly assembled or disassembled onto the lower edge of the prefabricated wall panels. The quick assembly connectors are placed between any two adjacent elements among the prefabricated wall panels, prefabricated roof panels, and prefabricated floor panels to secure their relative positions.

23 Claims, 24 Drawing Sheets

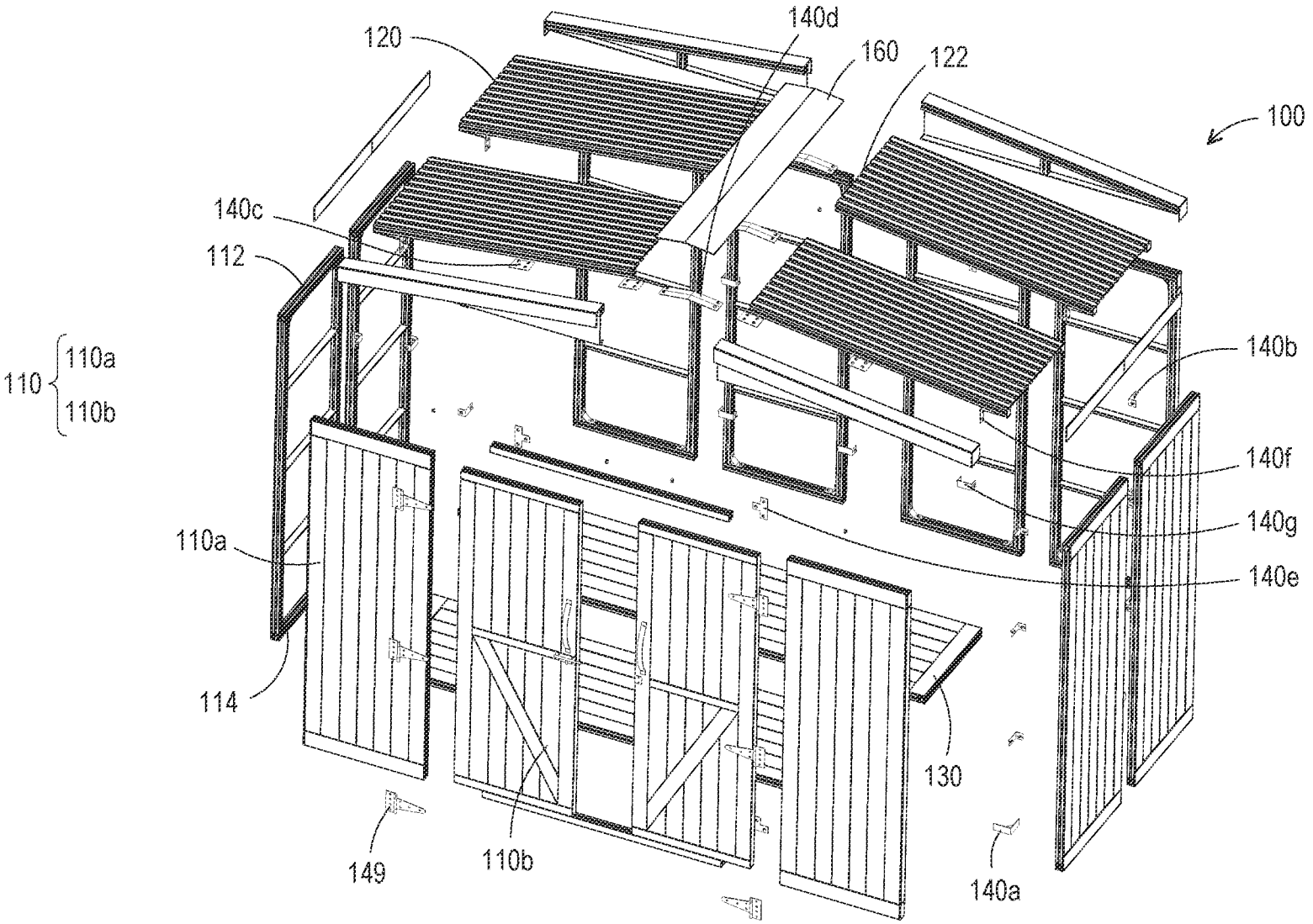
【Figure 1】

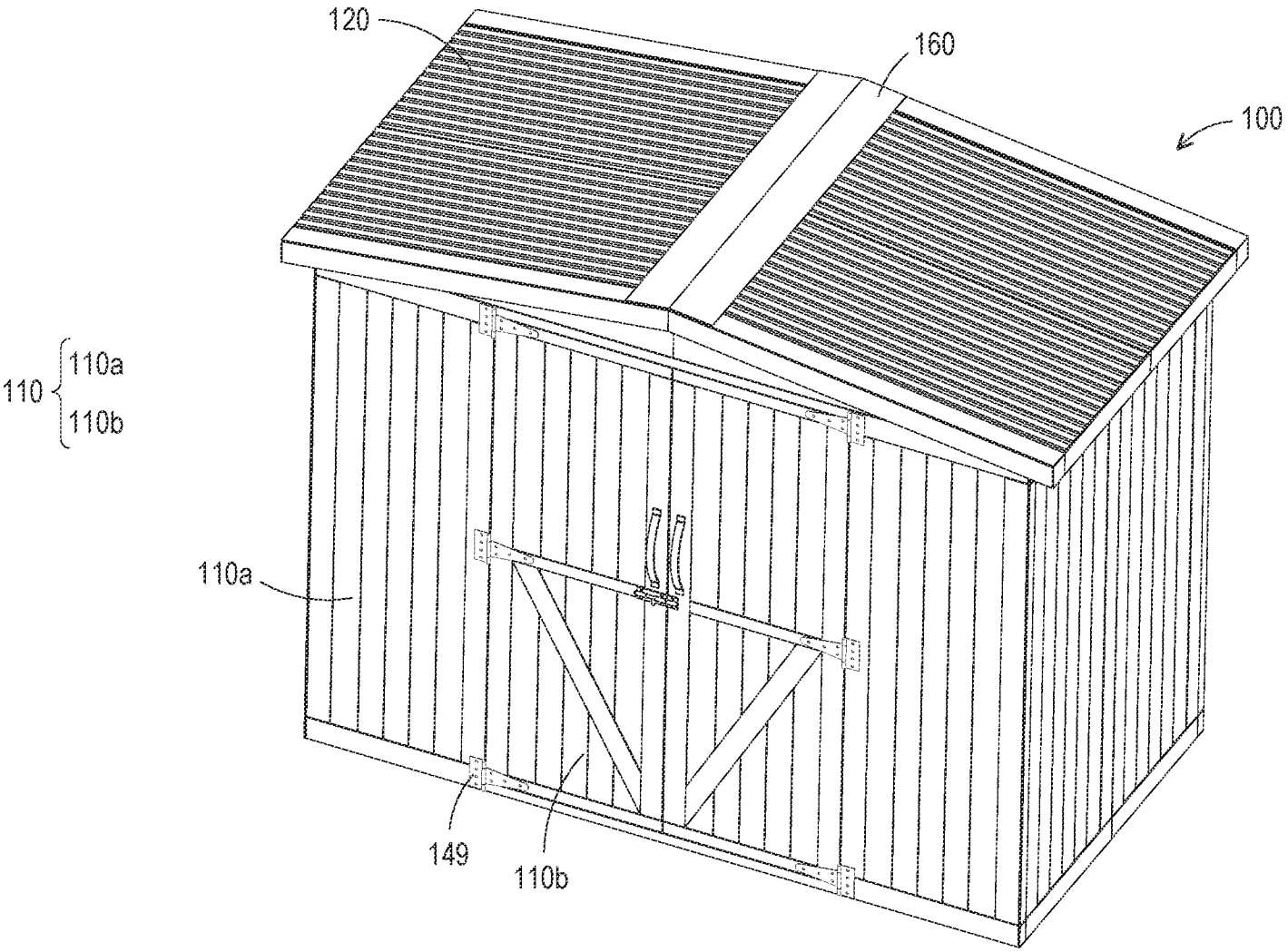
【Figure 2】

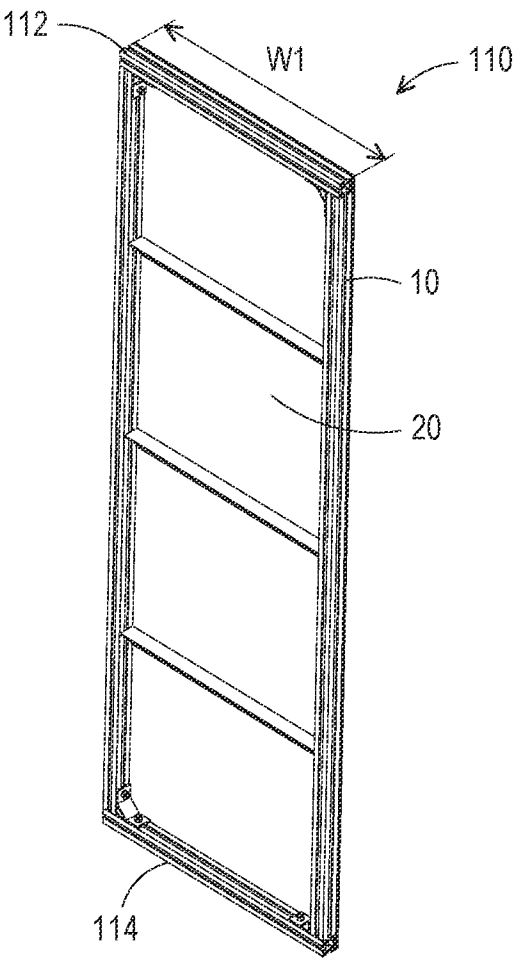
【Figure 3B】
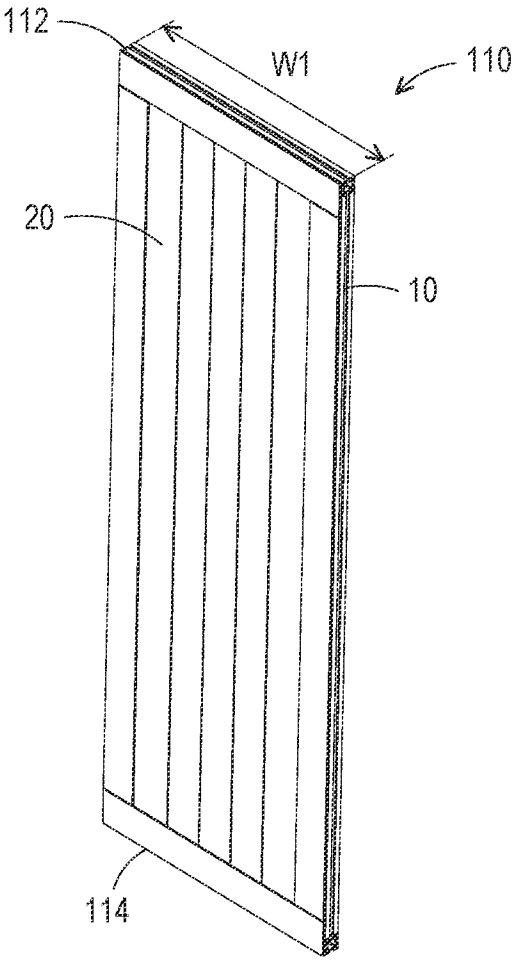
【Figure 3A】

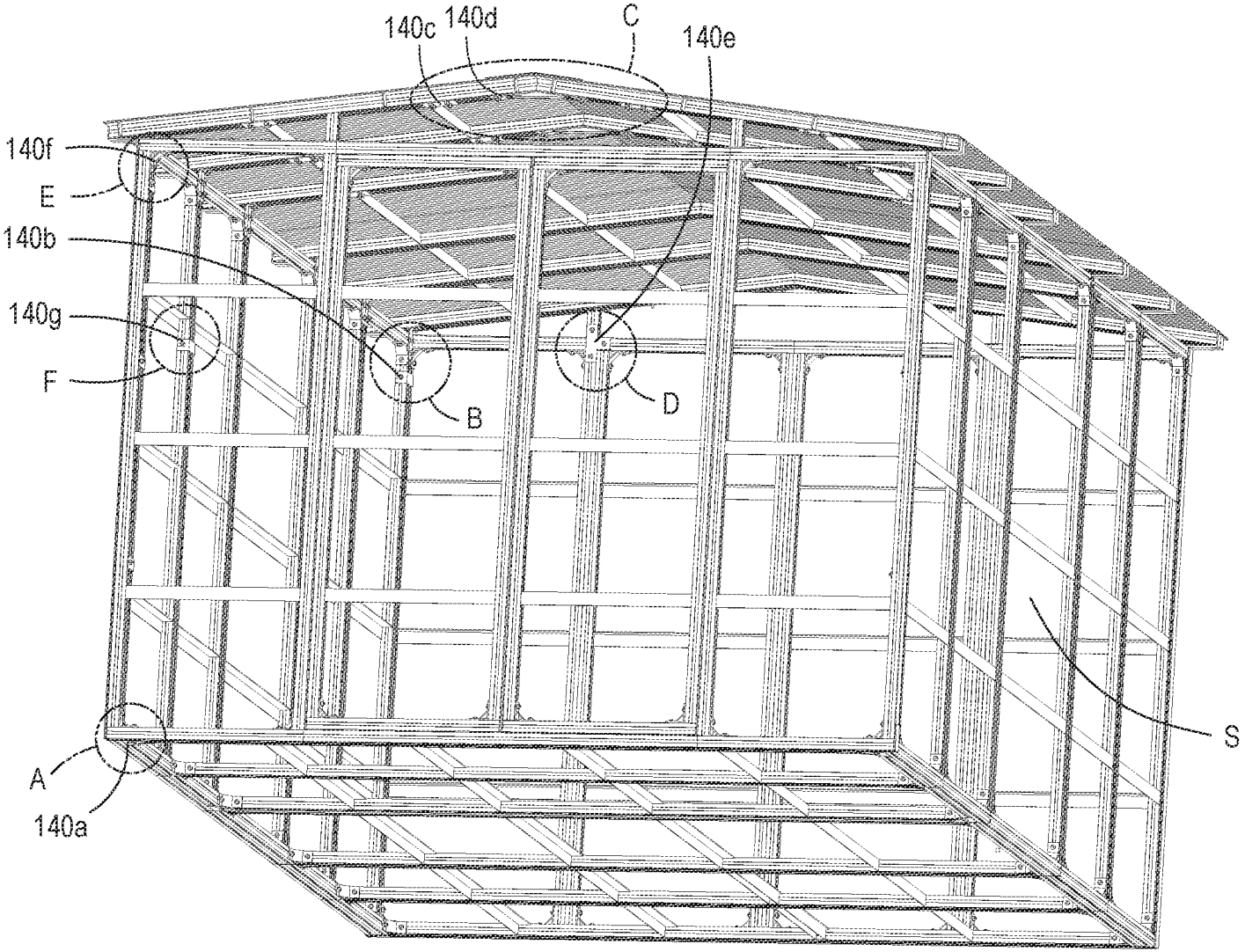
【Figure 4】

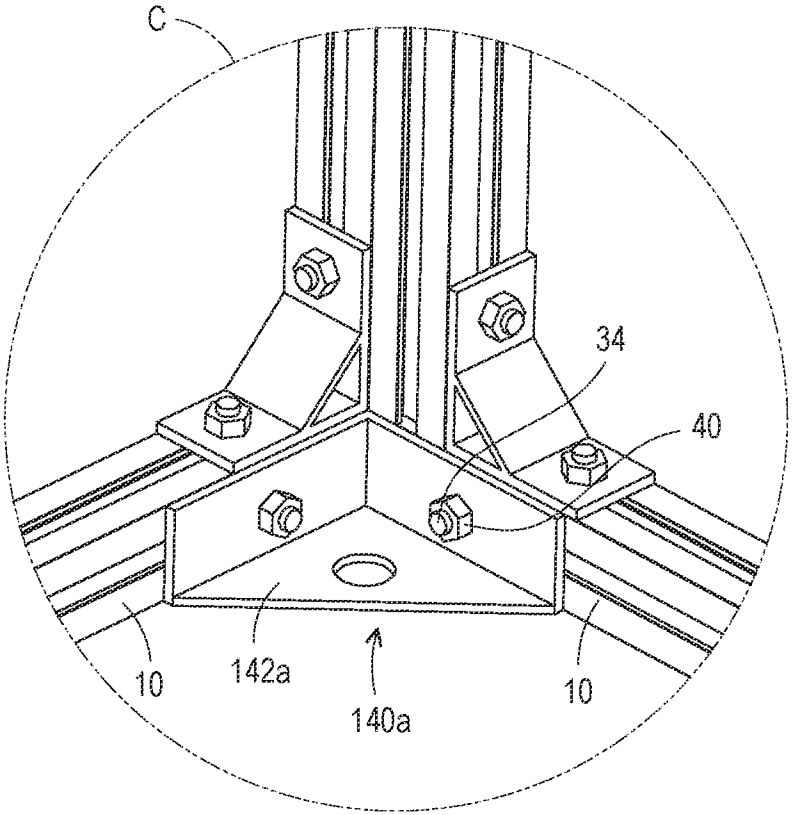
【Figure 5A】

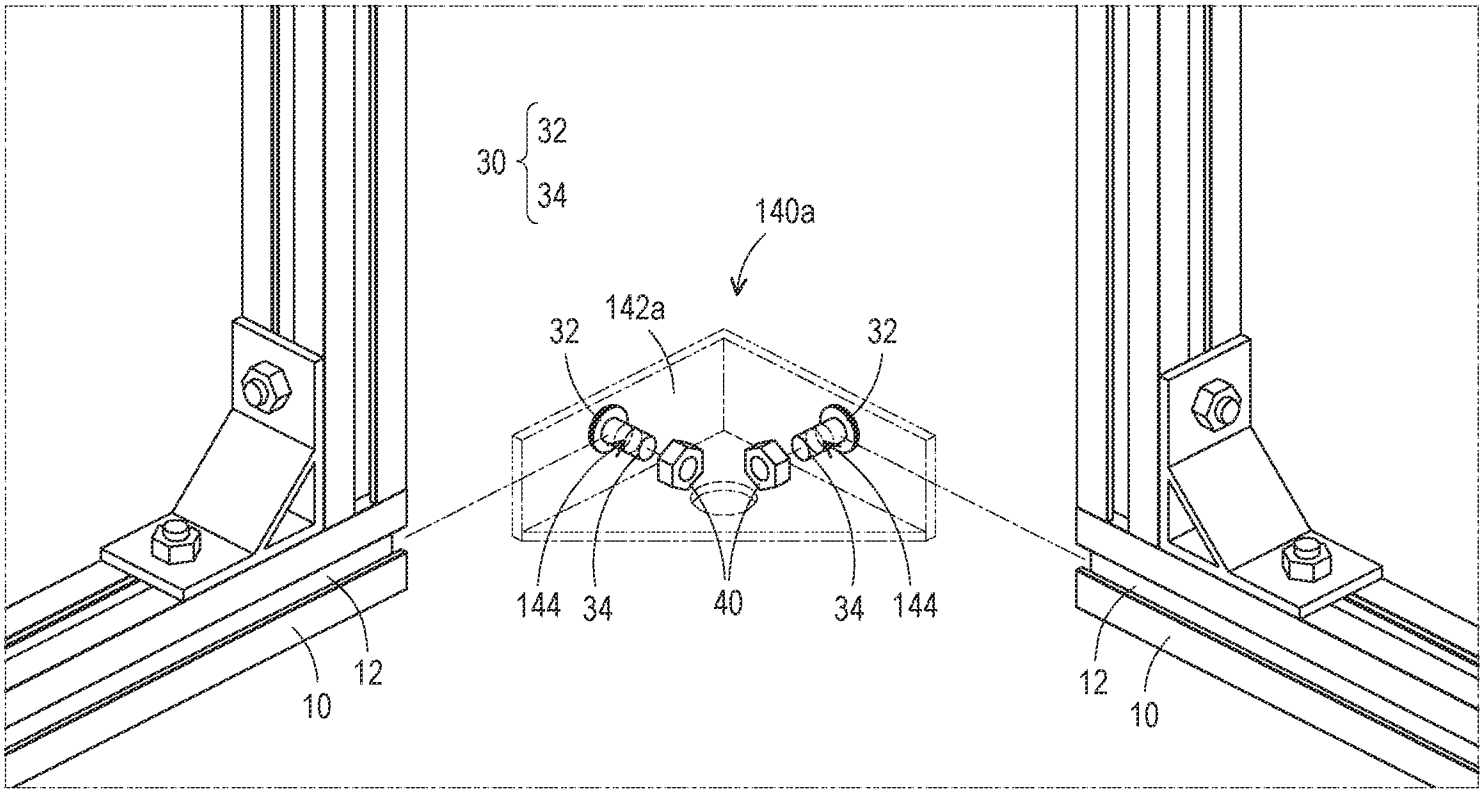
【Figure 5B】

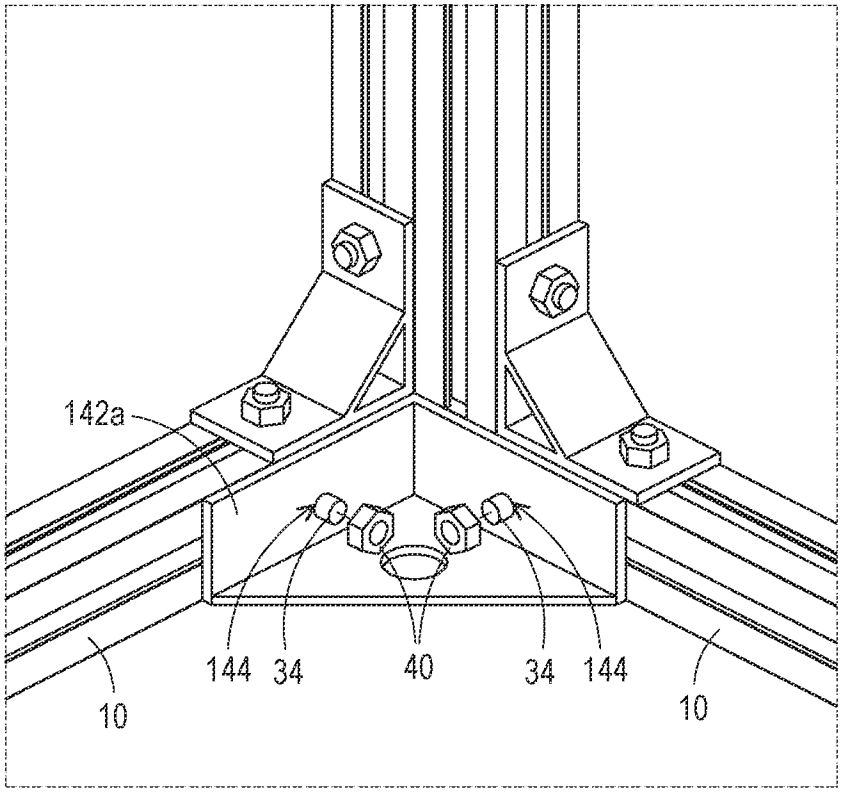
【Figure 5C】

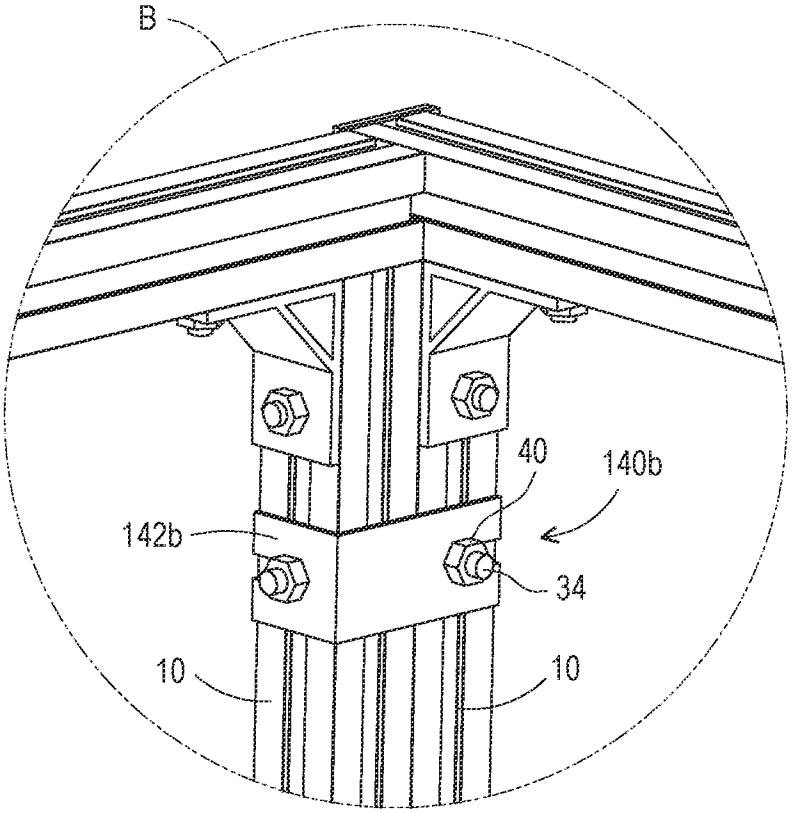
【Figure 6A】

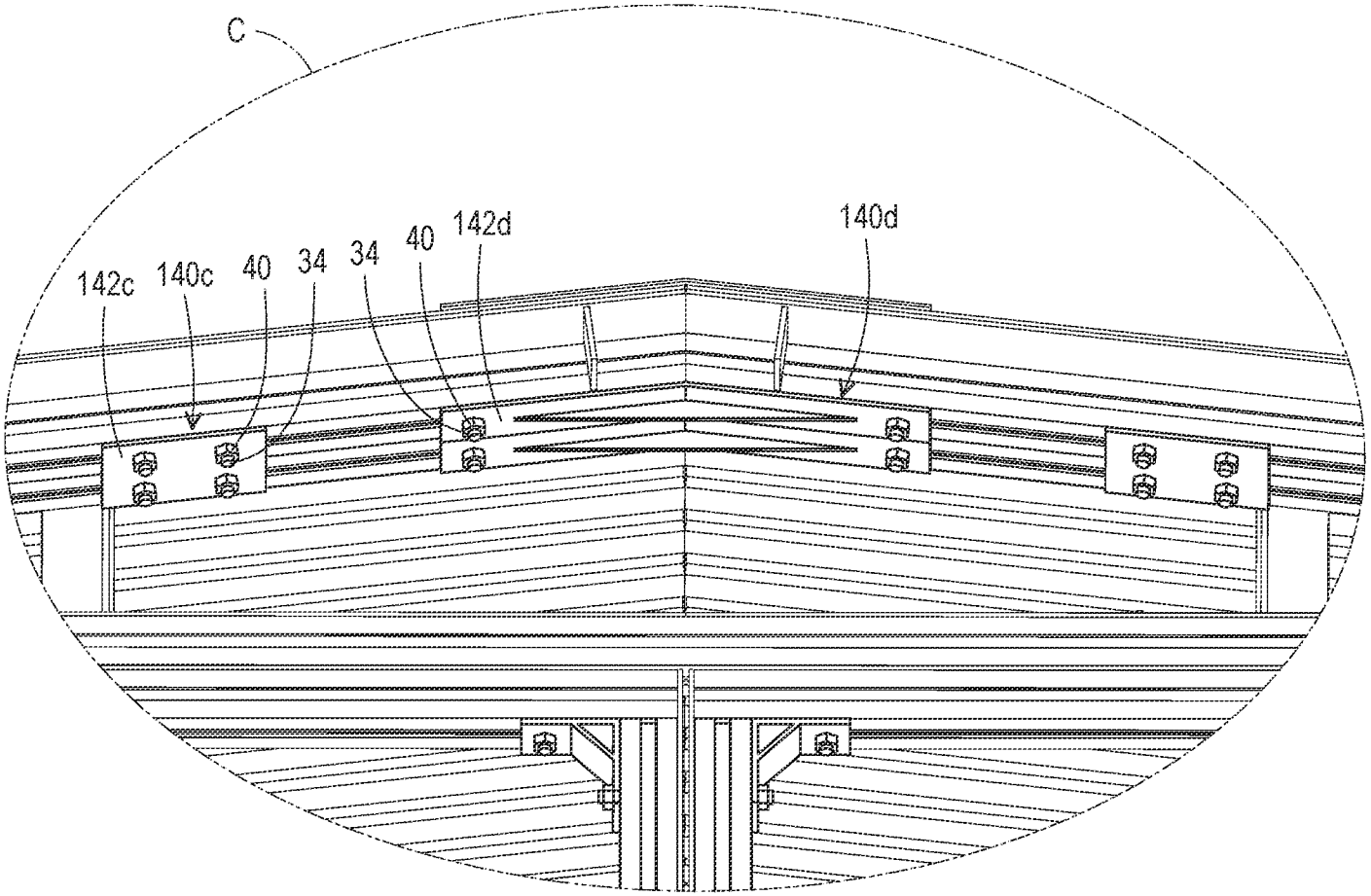
【Figure 6B】

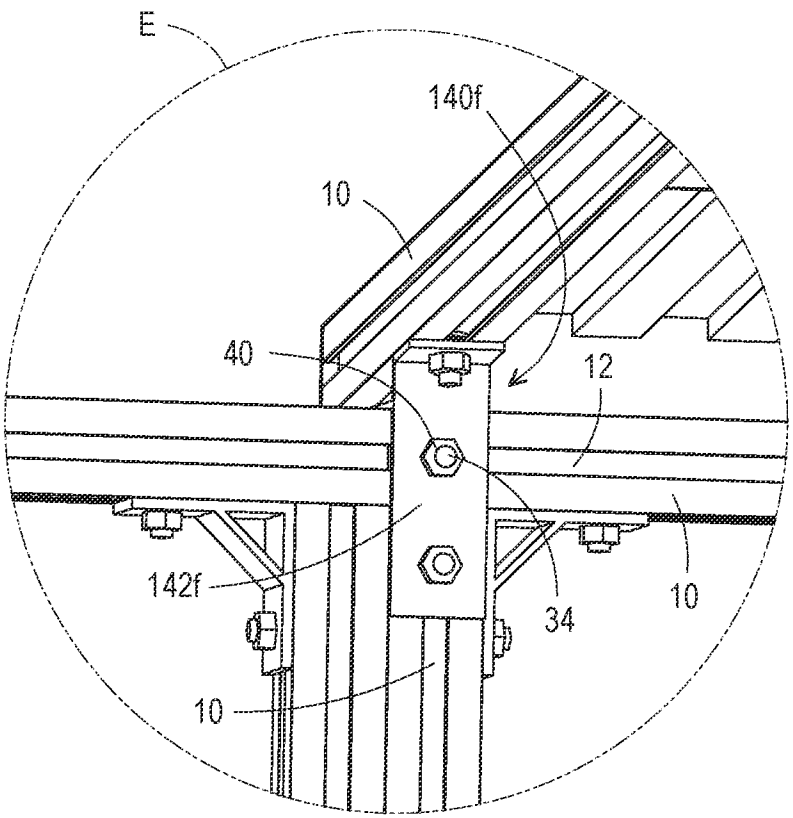
【Figure 7B】
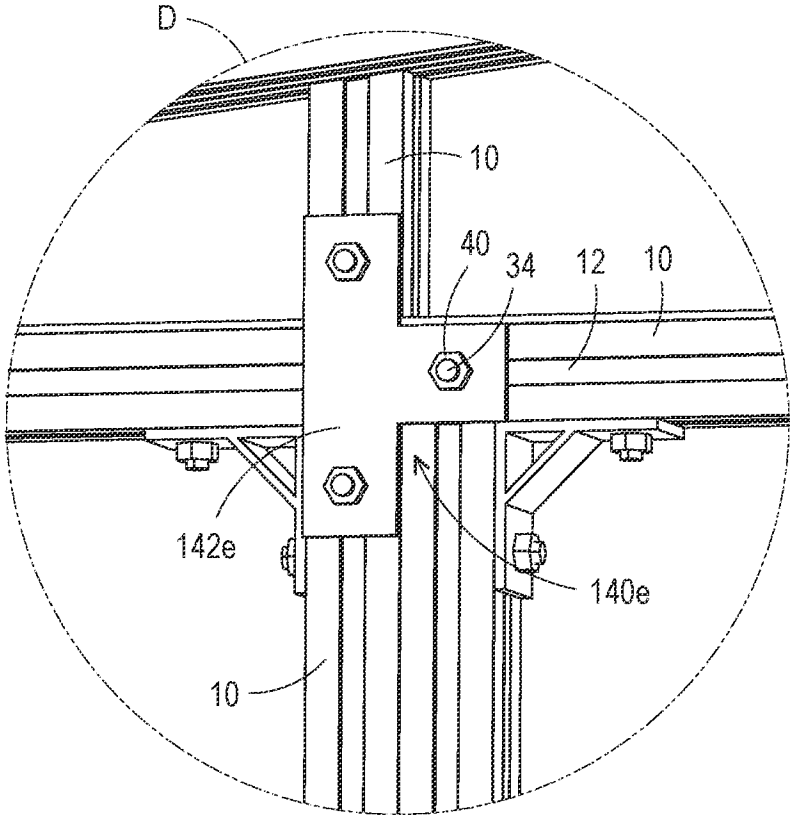
【Figure 7A】

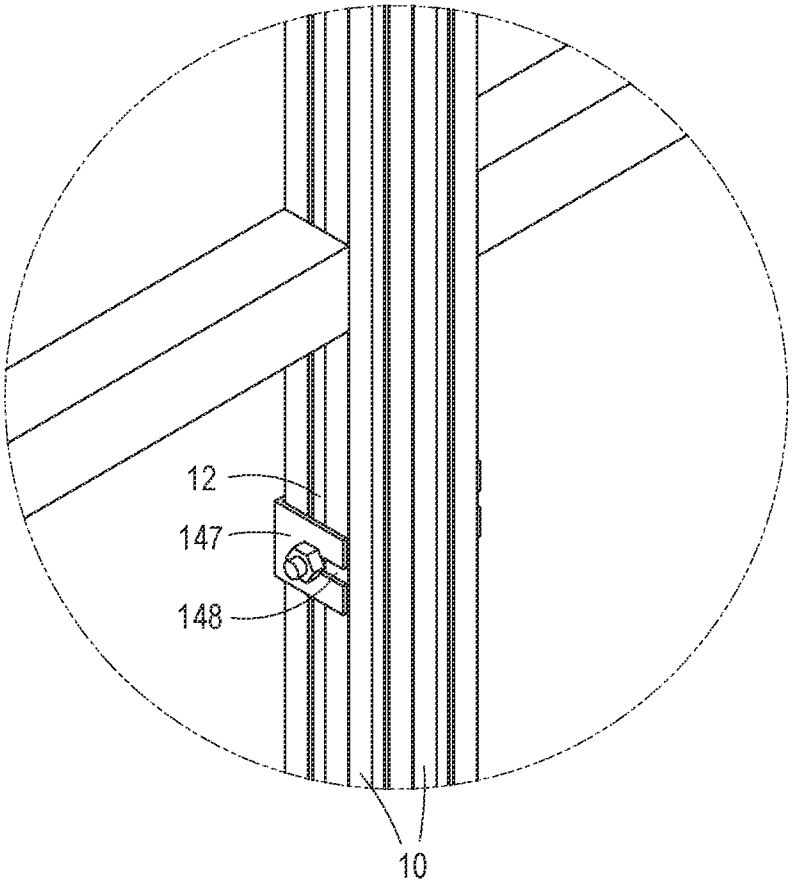
【Figure 8B】
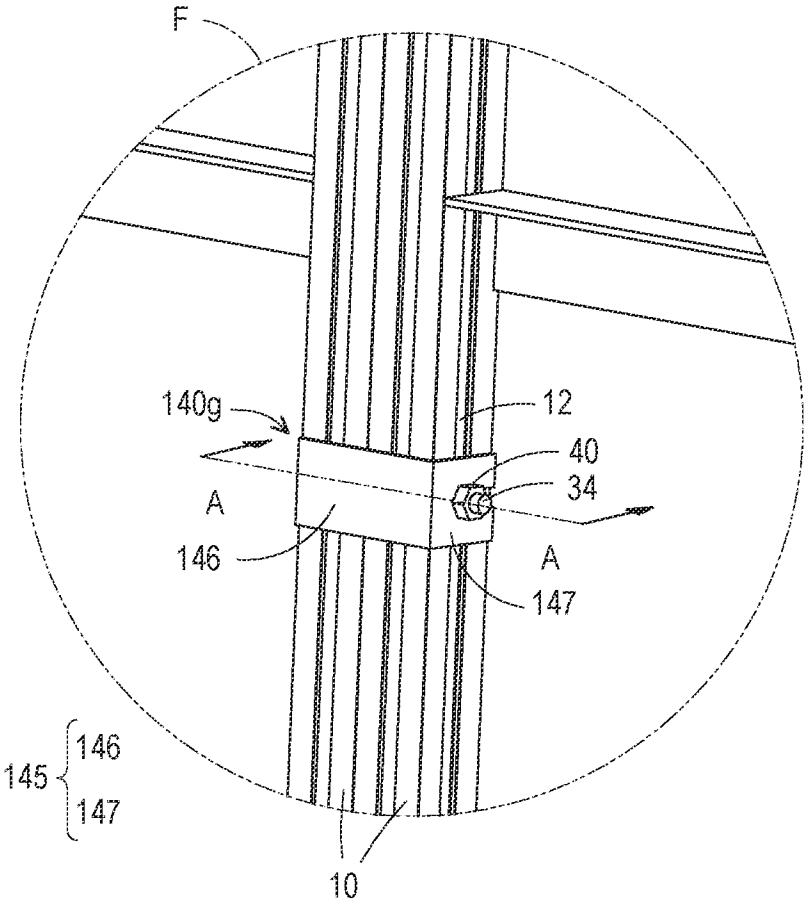
【Figure 8A】

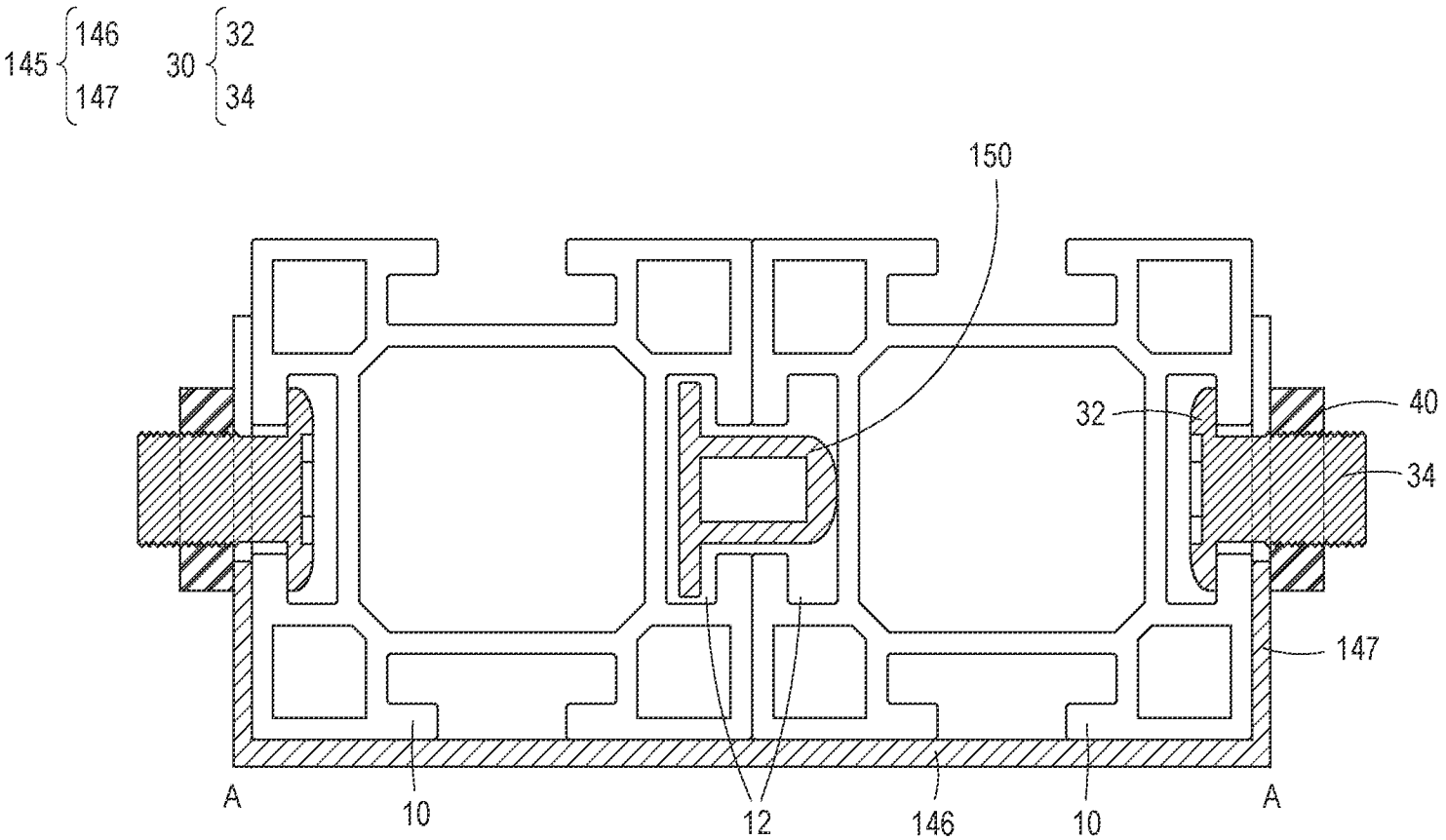
【Figure 9】

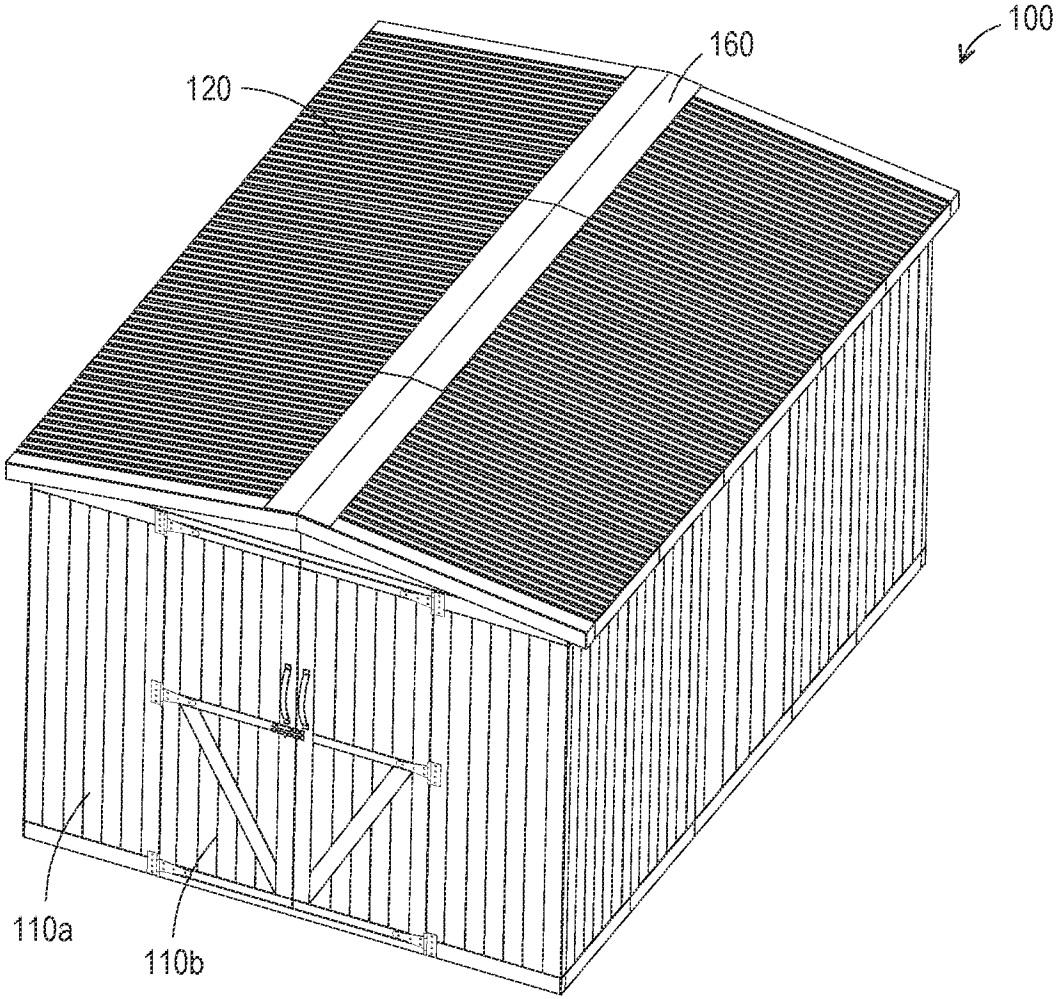
【Figure 10A】

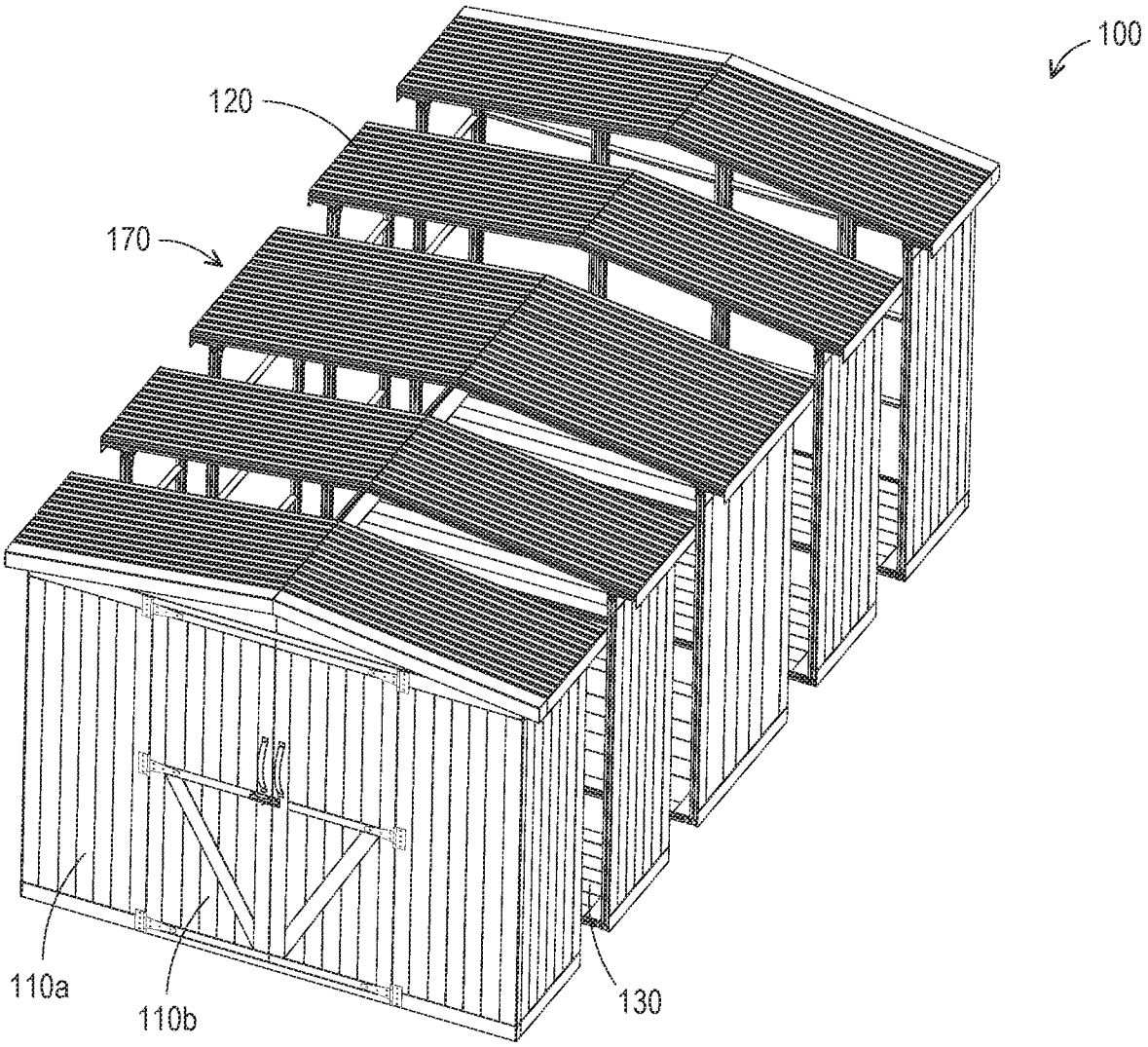
【Figure 10B】

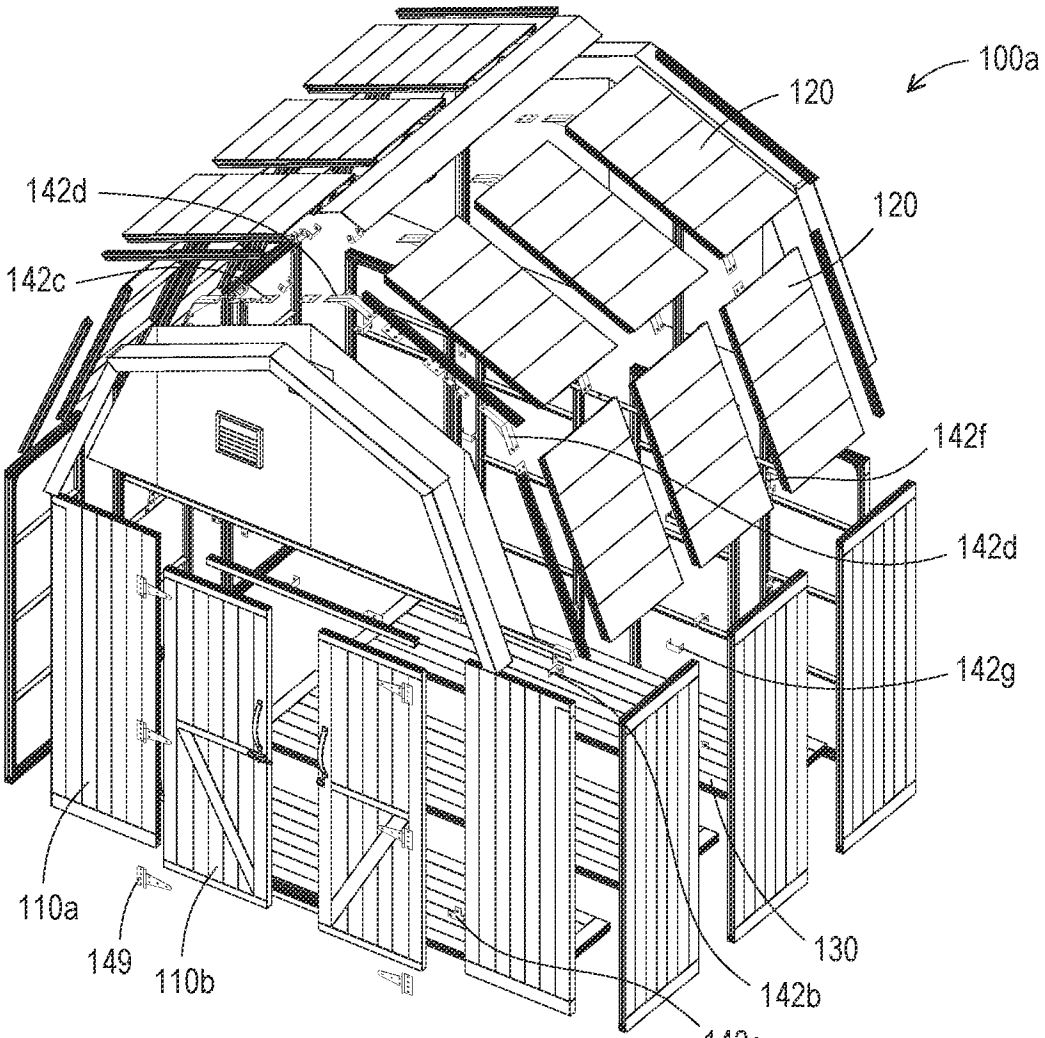
【Figure 11】
110 { 110a, 110b }

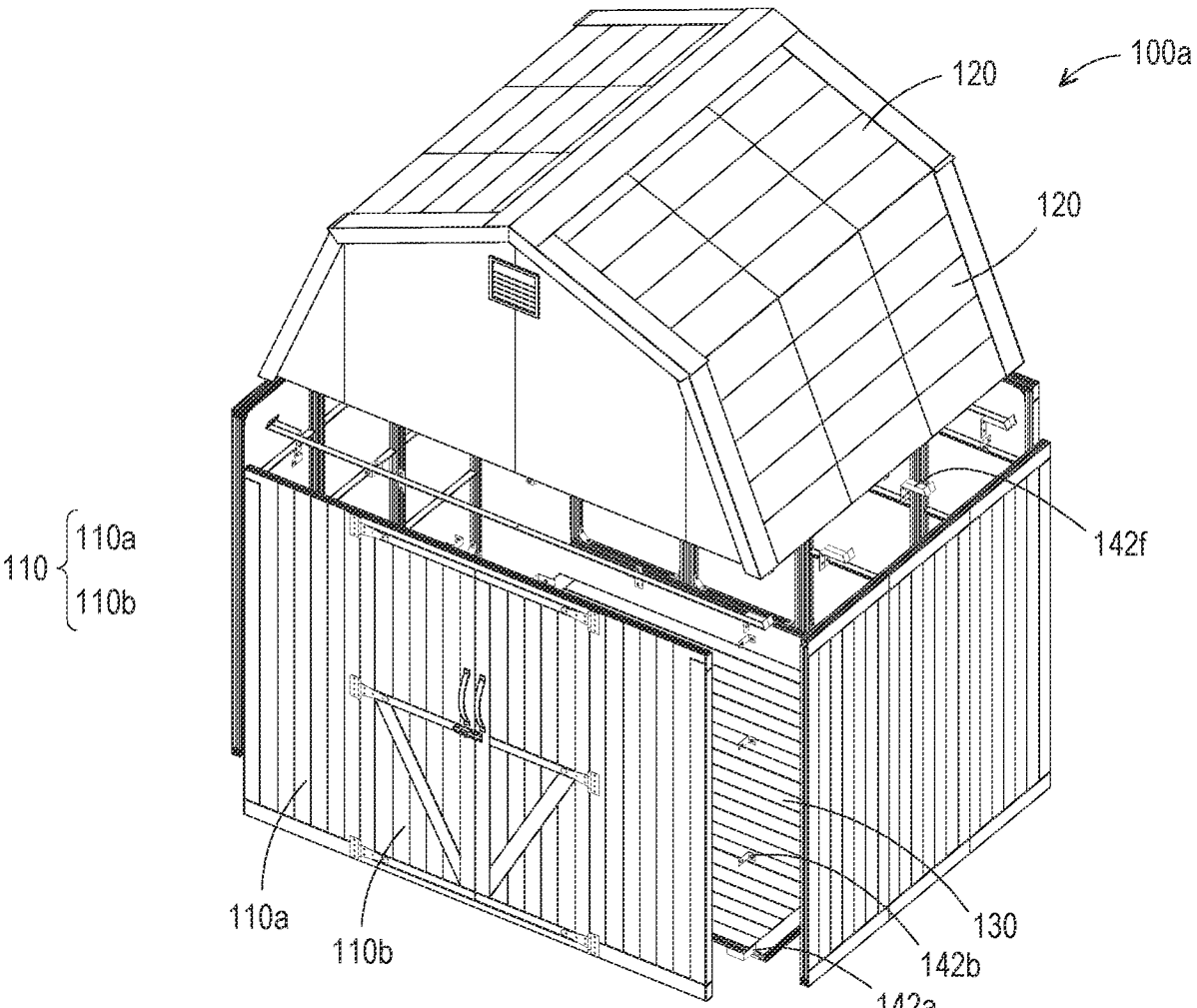
[Figure 12]

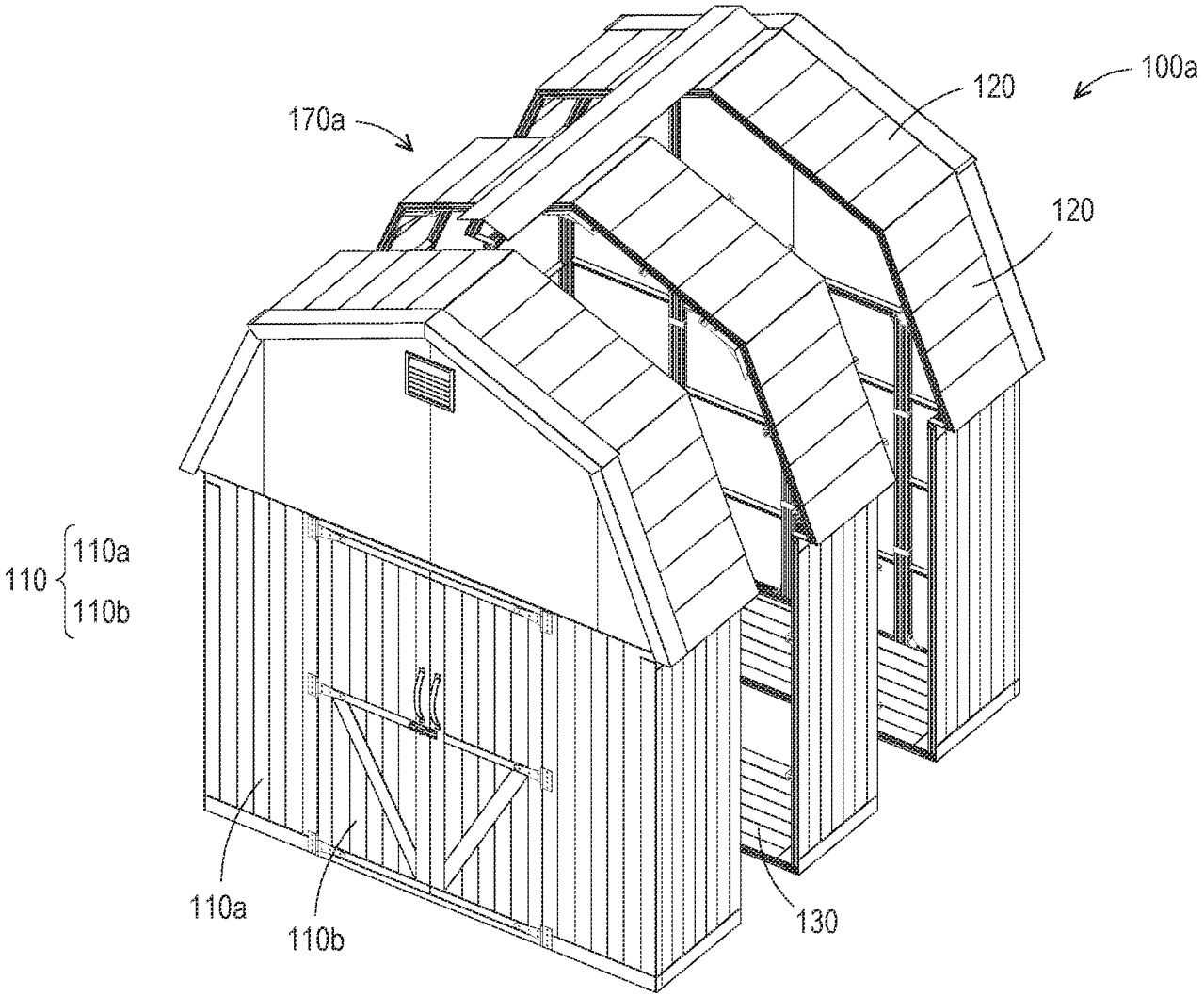
【Figure 13】

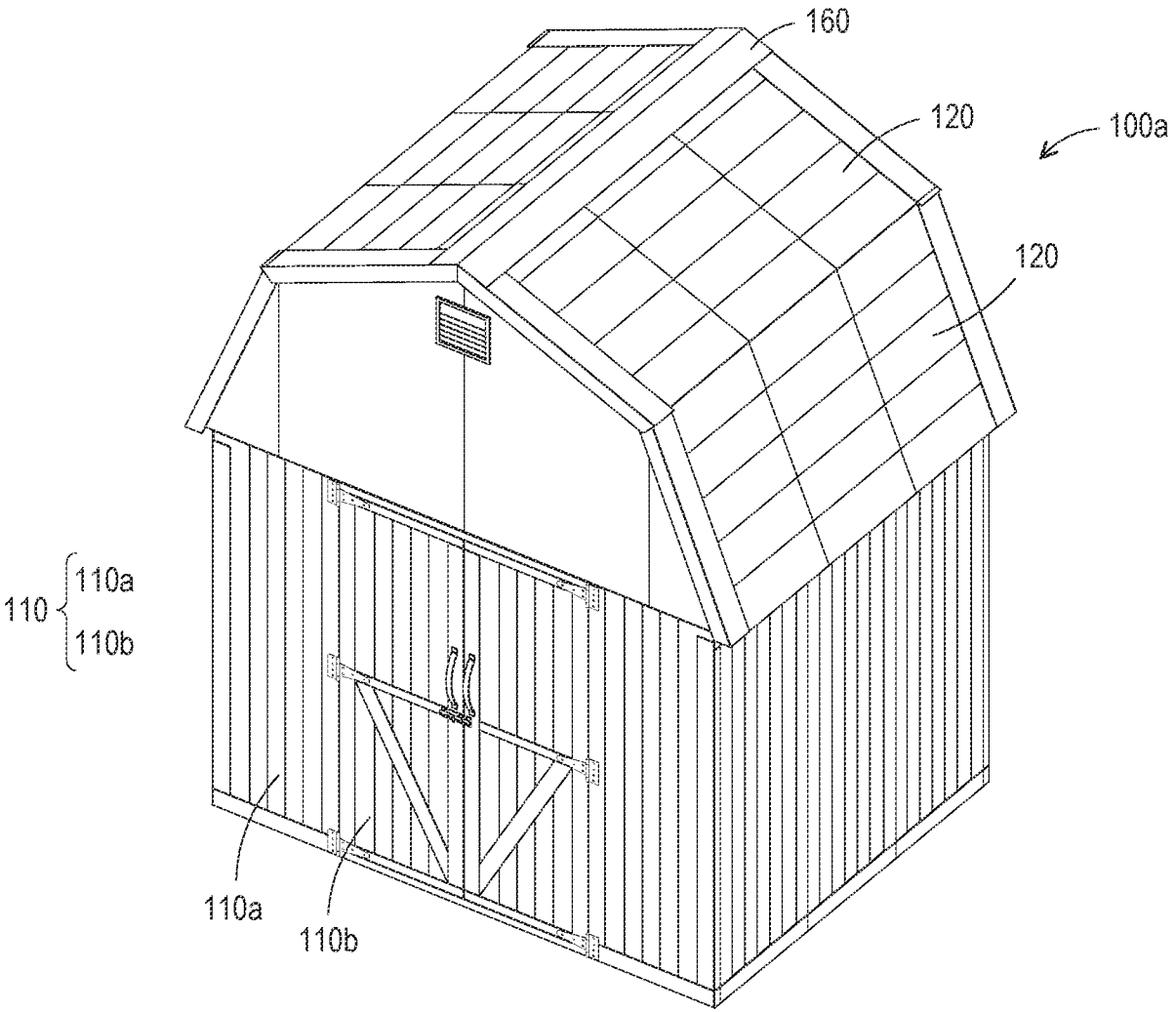
【Figure 14】

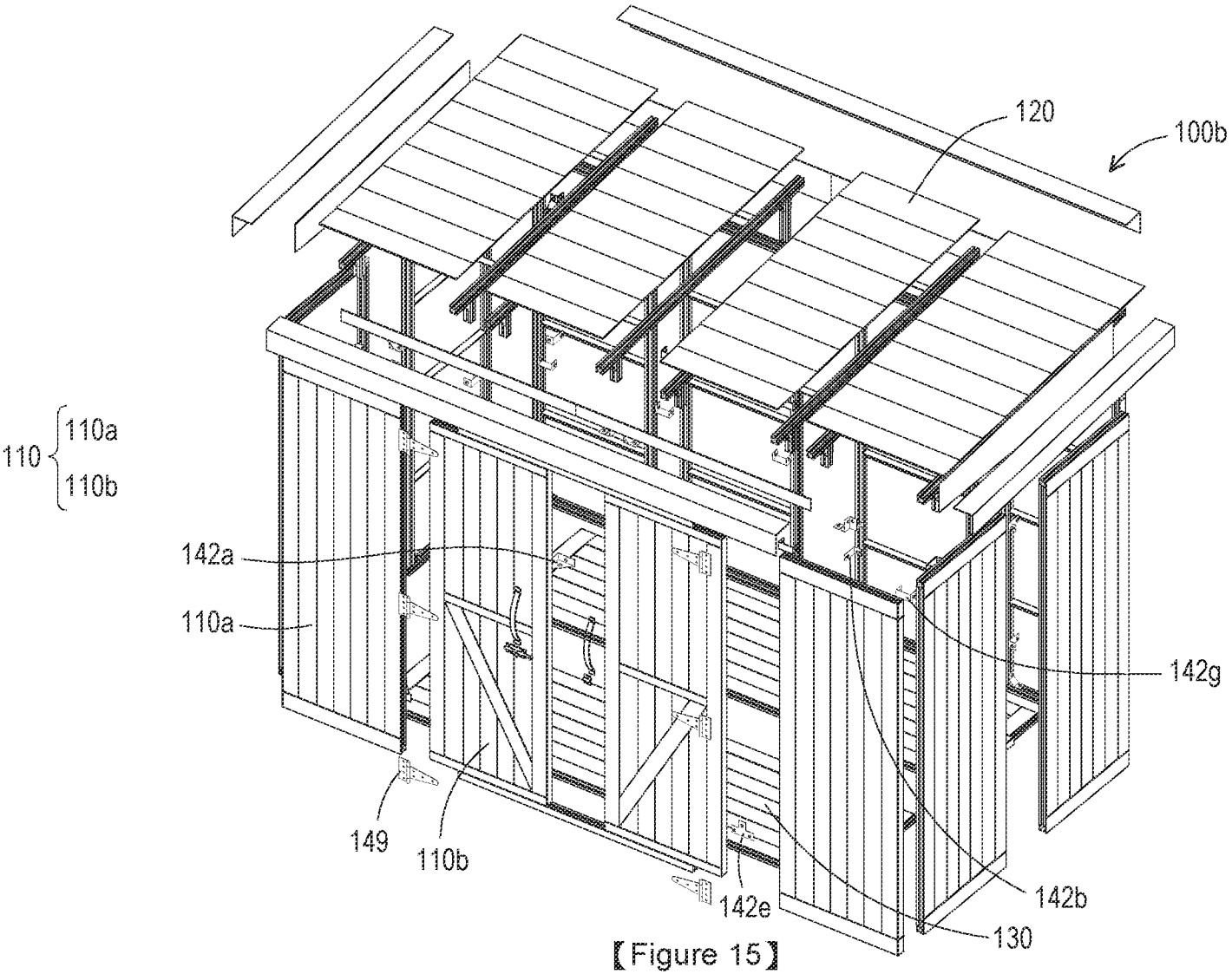
【Figure 15】

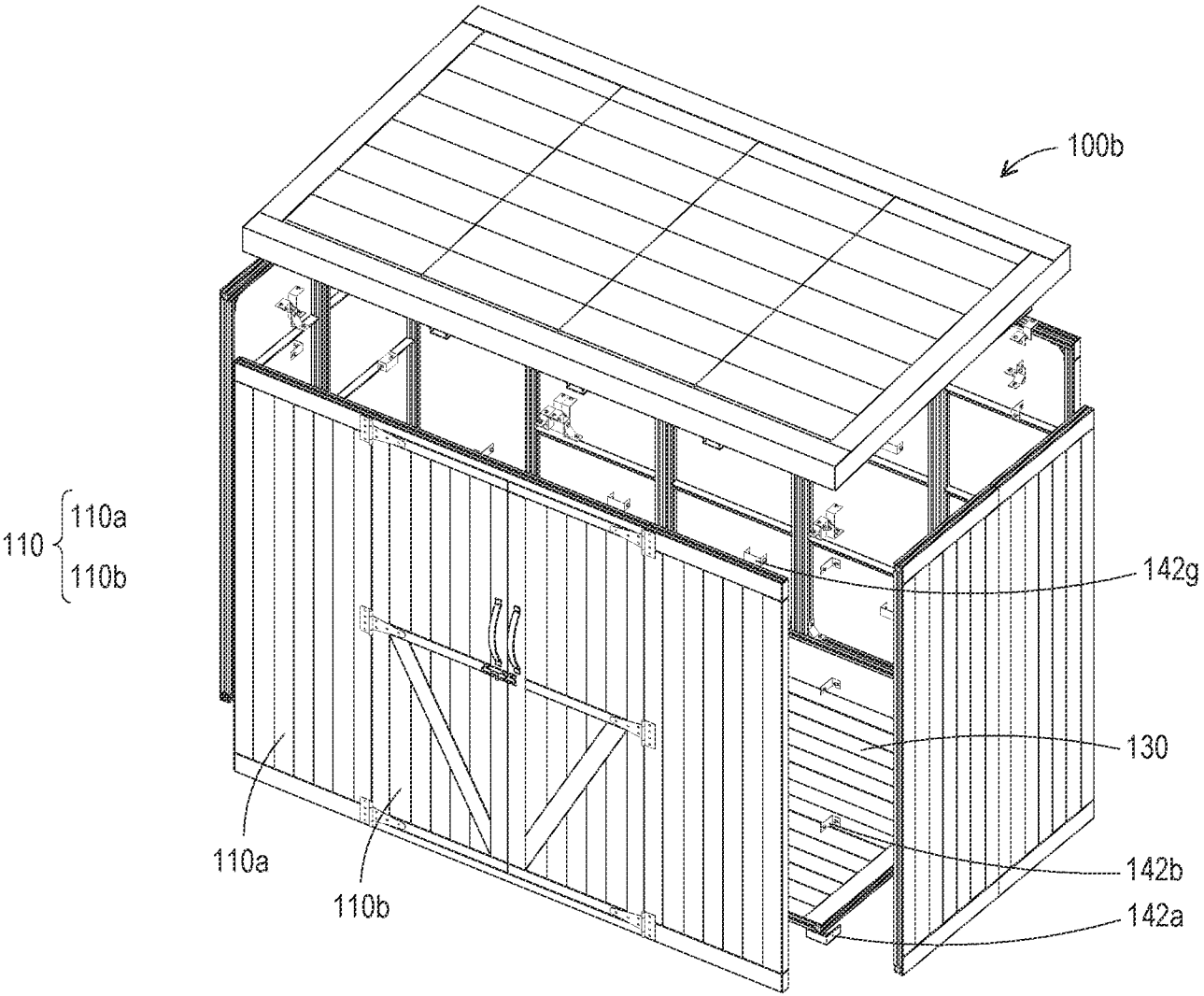
【Figure 16】

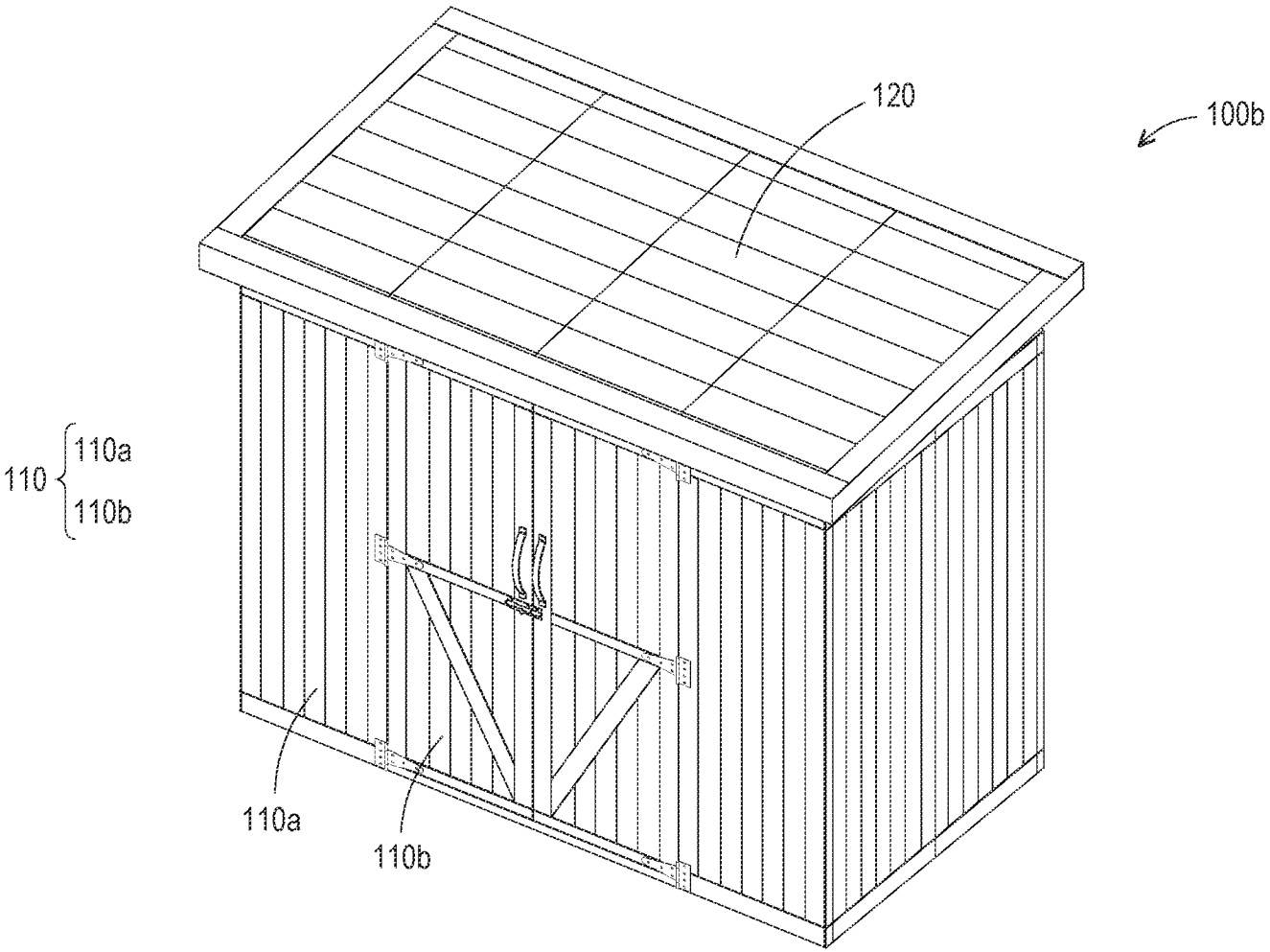
【Figure 17】

QUICK ASSEMBLED AND DISASSEMBLED SHED

TECHNICAL FIELD

The present invention relates to a shed that can be quickly assembled and disassembled, designed with efficient dismantling and assembly capabilities.

BACKGROUND

In conventional detachable sheds, the assembly process involves connecting beams and columns using connecting members to create the basic framework. Subsequently, decorative panels are affixed to the exterior of the framework to form roof panels, wall panels, and floors. However, these assembly methods are time-consuming and may result in interference between adjacent decorative panels due to fitting errors during the attachment process.

Furthermore, in conventional detachable sheds, the overall strength of the structure is achieved only after the entire framework is assembled and fixed. However, these designs are not easily completed by a single person during assembly and have limited flexibility when it comes to expanding and resizing of the shed.

SUMMARY OF THE INVENTION

The present invention introduces a shed system that can be easily and rapidly be assembled and disassembled. It comprises multiple wall, roof, and, preferably, floor panels, all separately pre-assembled and equipped with quick assembly connectors. By connecting these pre-assembled panels using the quick assembly connectors, the shed can be rapidly put together or taken apart.

The quick assembled and disassembled shed includes multiple pre-assembled wall panels, roof panels, floor panels, and quick assembly connectors. These pre-assembled wall panels can be rapidly assembled or disassembled to enclose a designated space. The pre-assembled roof panels can be quickly attached or detached to the upper edges of the wall panels, providing coverage for the space. Similarly, the pre-assembled floor panels, when included, can be quickly assembled or disassembled onto the lower edges of the wall panels to become the flooring. The quick assembly connectors are strategically positioned between any two adjacent wall panels, roof panels, and/or floor panels to ensure a secure and stable positioning and fitting of the panels.

In one embodiment of the present invention, the pre-assembled wall panels may have the same or different dimensions, the pre-assembled roof panels may have the same or different dimensions, and the pre-assembled floor panels may have the same or different dimensions.

In one embodiment of the present invention, any two adjacent pre-assembled wall panels, roof panels, or floor panels mentioned above include two outer frames. The two outer frames include two grooves. The quick assembly connectors include a quick assembly bracket, at least two screws, and at least two nuts. As used herein, the term "screw" refers to a fastener with a screw or bold head attached to a bolt shaft with threads. The nut includes threads that engage with the threads on the screw shaft in a conventional manner. Each screw is threaded into or extends through a hole in each quick assembly bracket. The outer frame of each panel includes a groove. One screw head slides into one of the grooves of the two adjacent outer frames such that the two bolt shafts protrude through the grooves with the quick assembly bracket against the outer frame. The nuts are threaded onto each bolt shaft to press the quick assembly bracket against the two outer frames.

In one embodiment of the present invention, any three adjacent pre-assembled wall panels, roof panels, or floor panels mentioned above include three outer frames with grooves. The quick assembly connectors consist of a quick assembly bracket, three screws that have bolt heads on one side of the quick assembly bracket and both shafts that extend or are threaded into holes in the quick assembly bracket, and three nuts. The screw heads slide into the grooves of the outer frames, such that the quick assembly bracket is against the panels and the bolt shafts protrude away from quick assembly bracket. The three nuts bolt onto the bolt shafts to compress the quick assembly connector against the outer frames.

In one embodiment of the present invention, the quick assembly connecting components include multiple U-shaped fixtures. Each U-shaped fixture clamps together two adjacent prefabricated wall panels, with their outer frames arranged side by side.

In one embodiment of the present invention, the two outer frames mentioned above include two recesses or grooves. Each U-shaped fixture includes a middle section and two side sections (legs) that are bent and connected to the middle section forming the U-shape. The side sections include two notches that are recessed from the direction away from the middle section. The quick assembly connecting components also include two screws and two nuts as described above. The two screw heads slide into the two recesses, the two bolt shafts protrude outward from the two outer frames and pass through the two notches of the side sections. The two nuts are threaded onto the two bolt shafts to compress the side sections against the two outer frames.

In one embodiment of the present invention, the aforementioned quick assembly and disassembly type shed further includes at least one flexible waterproof insert, which is installed between the adjacent prefabricated wall panels, roof panels, and floor panels.

In one embodiment of the present invention, the two adjacent ones among the aforementioned prefabricated wall panels and roof panels include two outer frames. The two outer frames include two recesses or grooves facing each other. Each flexible waterproof insert is installed within at least one groove of the adjacent two outer frames and more preferably in a groove on each of the adjacent two outer frames.

In one embodiment of the present invention, the quick assembly and disassembly type shed mentioned above further includes a joint structure. The prefabricated roof panels are arranged in an inverted V-shape, and the joint structure covers the top seam of the inverted V-shape.

In one embodiment of the present invention, the aforementioned prefabricated wall panels include multiple first prefabricated wall panels and at least one second prefabricated wall panel defining a door. The quick assembly connecting components include at least one hinge, and each hinge is installed between the corresponding second prefabricated wall panel and first prefabricated wall panel to allow the second prefabricated wall panel to rotate relative to the first prefabricated wall panel.

Based on the above, the quick assembly and disassembly type shed of the present invention includes the prefabricated wall panels, roof panels, and floor panels, which are fixed together by the quick assembly connecting components. Such prefabricated design improves efficiency during assembly and disassembly.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

FIG. 1 illustrates an exploded view of a quick assembly and disassembly type shed according to an embodiment of the present invention.

FIG. 2 illustrates a three-dimensional representation of the assembled quick assembly and disassembly shed shown in FIG. 1.

FIG. 3A illustrates a three-dimensional representation of a prefabricated wall panel according to an embodiment of the present invention.

FIG. 3B illustrates another perspective view of the rear side of the panel of FIG. 3A in three dimensions.

FIG. 4 illustrates a three-dimensional representation of the assembly of multiple prefabricated wall panels, multiple prefabricated roof panels, multiple prefabricated floor panels, depicting the outer frames of these panels (with the panels sections removed) and multiple quick assembly connecting components.

FIG. 5A illustrates a partial enlarged view of region A in FIG. 4 from another perspective.

FIG. 5B illustrates an exploded view of FIG. 5A.

FIG. 5C illustrates a three-dimensional representation of the assembled outer frames, quick assembly connectors, and screws shown in FIG. 5B.

FIG. 6A illustrates a partial enlarged view of region B in FIG. 4.

FIG. 6B illustrates a partial enlarged view of region C in FIG. 4.

FIG. 7A illustrates a partial enlarged view of region D in FIG. 4.

FIG. 7B illustrates a partial enlarged view of region E in FIG. 4 from another perspective.

FIG. 8A illustrates a partial enlarged view of region F in FIG. 4 from another perspective.

FIG. 8B illustrates a three-dimensional representation of FIG. 8A from another perspective.

FIG. 9 illustrates a sectional view of two adjacent prefabricated wall panels with their outer frames along the line segment A-A in FIG. 8.

FIG. 10A illustrates a three-dimensional representation of another embodiment of the present invention.

FIG. 10B illustrates a three-dimensional representation of the assembly of FIG. 10A showing modular expansions.

FIG. 11 illustrates an exploded view of a quick assembly and disassembly type shed according to another embodiment of the present invention.

FIG. 12 illustrates a three-dimensional representation of the prefabricated roof panels, prefabricated wall panels, and prefabricated floor panels of the quick assembly and disassembly type shed shown in FIG. 11, forming the roof, multiple walls, and floor.

FIG. 13 illustrates a three-dimensional representation of the quick assembly and disassembly type shed shown in FIG. 11 showing modular expansions.

FIG. 14 illustrates a three-dimensional representation of the assembled quick assembly and disassembly type shed shown in FIG. 11.

FIG. 15 illustrates an exploded view of a quick assembly and disassembly type shed according to yet another embodiment of the present invention.

FIG. 16 illustrates a three-dimensional representation of the prefabricated roof panels, prefabricated wall panels, and prefabricated floor panels of the quick assembly and disassembly type shed shown in FIG. 15, forming the roof, multiple walls, and floor.

FIG. 17 illustrates a three-dimensional representation of the assembled quick assembly and disassembly type shed shown in FIG. 15.

DETAILED DESCRIPTION

Figure 3D:
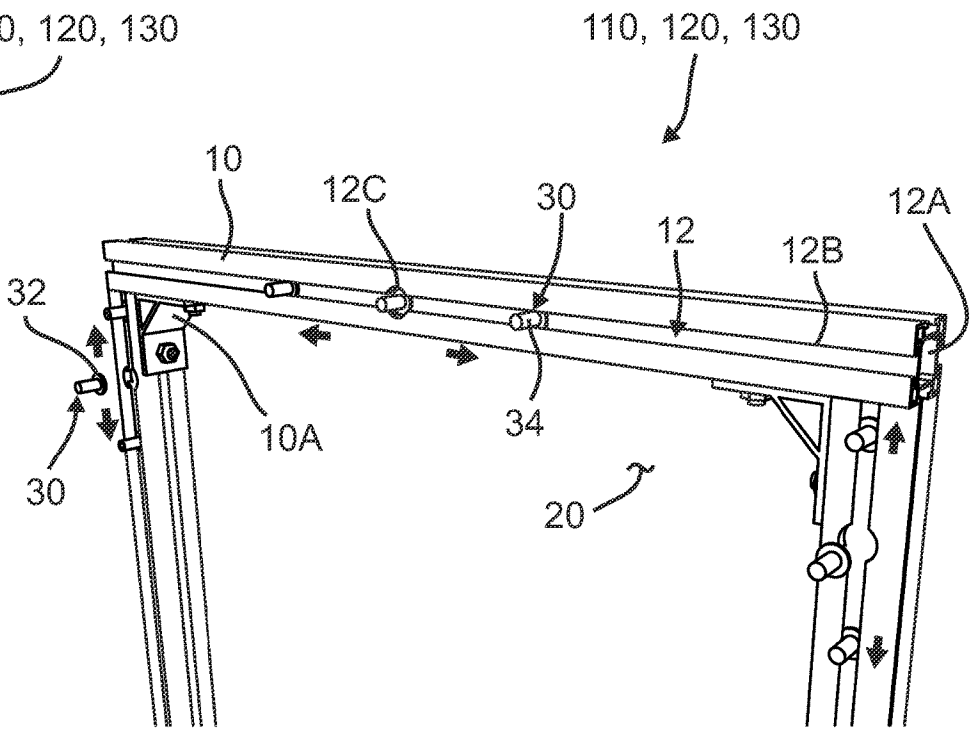
FIG. 3D is an enlarged portion of the outer frame of FIG. 3C illustrating the attachment of fasteners to the outer frame.

FIG. 1 is an exploded view of a quick assembly and disassembly shed according to an embodiment of the present invention. FIG. 2 is a three-dimensional view of the assembled quick assembly and disassembly shed shown in FIG. 1.

In accordance with the present embodiment, as depicted in FIGS. 1 and 2, the disclosed shed structure (100) features a rapid assembly and disassembly mechanism. The shed comprises a plurality of pre-assembled wall panels (110), pre-assembled roof panels (120), pre-assembled floor panels (130), and quick assembly connectors (140*a*, 140*b*, 140*c*, 140*d*, 140*e*, 140*f*, 140*g*). The pre-assembled wall panels (110) are designed to be easily disassembled and assembled, allowing them to enclose a defined space (S), as illustrated in FIG. 4. The roof panels may be identical to one another to facilitate interchanging and replacement. The same with the wall panels and floor panels.

To effectively cover the enclosed space (S), the pre-assembled roof panels (120) are promptly assembled or disassembled, providing a secure fit over the upper edges (112) of the pre-assembled wall panels (110). Similarly, the pre-assembled floor panels (130) can be swiftly assembled or disassembled to align with the lower edges (114) of the pre-assembled wall panels (110). Ensuring stability and structural integrity, the quick assembly connectors (140*a*, 140*b*, 140*c*, 140*d*, 140*e*, 140*f*, 140*g*) are positioned between any two adjacent pre-assembled wall panels (110), pre-assembled roof panels (120), and pre-assembled floor panels (130), securely maintaining their relative positions.

While the current embodiment does not explicitly depict external windows on the pre-assembled wall panels (110) and pre-assembled roof panels (120), it is important to note that various other embodiments can incorporate different quantities of external windows, catering to specific user preferences and requirements.

Moreover, the disclosed quick assembly and disassembly shed (100) further incorporates a joint structure or cap (160). The pre-assembled roof panels (120) are arranged in an inverted V shape, and the joint structure or cap (160) covers the top joint (122) of the inverted V shape. The joint cap is, preferably, a one piece component that is in the shape of an inverted V-shape so as to correspond to the shape of the two preassembled roof panels where they meet to define the peak of the building structure. The joint cap (160) preferably connects to the roof panel. Conversely, the pre-assembled wall panels (110) consist of multiple first pre-assembled wall panels (110*a*) and at least one second pre-assembled wall panel (110*b*), which in one embodiment is a door. It should be apparent that the second wall panel (110*b*) may be different than the first wall panel (110*a*). Additionally, the quick assembly and disassembly shed (100) includes at least one hinge member (149). Each hinge member (149) is positioned between the corresponding second pre-assembled wall panel (110*b*) and first pre-assembled wall panel (110*a*), enabling rotational movement of the second pre-assembled wall panel (110*b*) with respect to the first pre-assembled wall panel (110*a*).

FIG. 3A presents a three-dimensional view of a pre-assembled wall panel in accordance with an embodiment of the present invention. FIG. 3B provides an additional perspective view of FIG. 3A.

Referring to FIGS. 3A and 3B, the pre-assembled wall panel (110) comprises a frame (10) and panels (20). In this embodiment, the frame (10) is constructed using aluminum, while the panels (20) are composed of synthetic wood. However, it should be noted that the materials of the frame (10) and panels (20) are not limited to this particular combination. For example, the frame may be extruded plastic and the panels may be plastic sheets (flat or contoured). Furthermore, the pre-assembled roof panels (120) and pre-assembled floor panels (130) are likewise assembled using the frame (10) and panels (20) in a similar manner.

Importantly, it is noteworthy that in this embodiment, prior to user assembly, the frame (10) and panels (20) have already been pre-assembled into prefabricated wall panels (110), prefabricated roof panels (120), and prefabricated floor panels (130). This design of prefabricated structural units significantly enhances the efficiency of user assembly or disassembly of the quick assembly and disassembly shed (100) while minimizing potential interferences resulting from fitting errors between adjacent prefabricated wall panels (110), prefabricated roof panels (120), or prefabricated floor panels (130). The panels 20 may be attached to the outer facing sides of the frames 10 through any conventional means, such as fasteners or adhesive. In an embodiment the panels 20 are glued to the outer facing sides of the frames.

In contrast, the width dimension (W1) of the prefabricated wall panels (110) can vary. In this embodiment, the width dimension (W1) can be either 2 feet or 3 feet, however, it is important to note that the width dimension (W1) of the prefabricated wall panels (110) is not limited to these specific values. In different embodiments, during the combination and assembly of the prefabricated wall panels (110), certain panels may have a width of 2 feet while others may have a width of 3 feet. The upper edge (112) and lower edge (114) of these prefabricated wall panels (110) securely align with the prefabricated roof panels (120) and prefabricated floor panels (130), and their width dimension (W1) may be uniform or different. Users are given the flexibility to select prefabricated wall panels (110), prefabricated roof panels (120), and prefabricated floor panels (130) with various width dimensions (W1) to customize spaces of different sizes (S) according to their specific requirements (see FIG. 4).

Figure 3C:
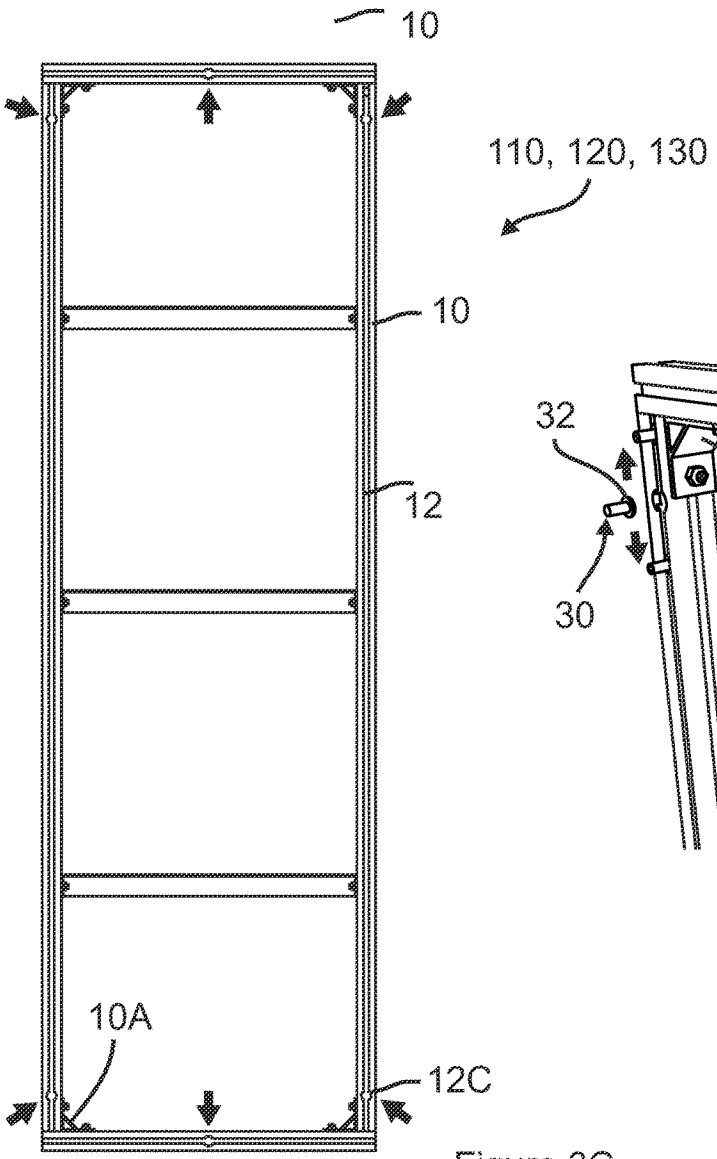
FIG. 3C illustrates a rear view of the outer frame of a wall panel, roof panel, and/or floor panel according to an embodiment of the present invention.

Referring to FIGS. 3C and 3D, a rear view of the outer frame of a wall panel, roof panel, and/or floor panel (110, 120, 130) according to an embodiment of the present invention is shown. As noted above, the wall panels, roof panels, and floor panels (110, 120, 130) preferably are provided pre-assembled and each include preferably at least four frames (10) that form the periphery of each panel (110, 120, 130). The adjacent frames (10) in a panel are attached to one another, preferably at or near their ends, by corner braces (10A) so as to form a rigid or stiffened structure. Secondary crossbeams (10B), such as angle brackets, may be secured between two or more frames (10) to provide additional stiffness if needed.

As discussed above, each frame (10) includes a groove (12) formed on at least one side of the frame (10). More preferably, two or more sides of the frame (10) each have a groove (12) formed in it. The groove (12) preferably extends from one end of the frame (10) to the other. The grooves (12) comprise a preferably C-shaped channel (12A) with a slotted opening (12B) facing outward on one side as shown in more detail in FIG. 9. The width ($12W_1$) of the channel (12A) is larger than the width ($12W_2$) of the slotted opening (12B). The width ($12W_2$) of the slotted opening (12B), in turn, is larger than that diameter of the shaft (34) of the screws (30). The grooves (12) may be open at their axial ends so as to permit a quick assembly connector (140*a*, 140*b*, 140*c*, 140*d*, 140*e*, 140*f*, 140*g*) to be attached as discussed below. The grooves (12) on at least the inner (rear) facing side of frame (10) may include one or more holes (12C) that are formed in the slotted opening (12B). Each hole (12C) has a diameter that is larger than the width ($12W_2$) of the slotted opening (12B), and is preferably about the same side as the width ($12W_1$) of the channel (12A). More importantly, the size of the hole (12C) is sufficiently large so as to receive the head (32) of a screw (30) of quick assembly connector (140*a*, 140*b*, 140*c*, 140*d*, 140*e*, 140*f*, 140*g*).

The access holes (12C) are each located inward from the end of the frame (10). In some cases the locations of the access holes (12C) are chosen so as to be near locations where the quick assembly connectors (140*a*, 140*b*, 140*c*, 140*d*, 140*e*, 140*f*, 140*g*) are to be attached. The arrows in FIG. 3C indicate where the holes (12C) are located in one embodiment.

As shown in FIG. 3D and as will be better understood in light of the discussion below, to attach a quick assembly connector (140*a*, 140*b*, 140*c*, 140*d*, 140*e*, 140*f*, 140*g*) the head (32) of a screw (30) of the quick assembly connector is inserted into the channel (12A) either through an open end of the groove (12) or, more preferably, by inserting the head 32 into an access hole (12C) close to where it is desired to attach the quick assembly connector with the screw shaft (34) extending outward through the slotted opening (12B). Thus, the slotted opening (12B) of the groove 12 prevents the screw (30) from being removed except at the ends or through the holes (12C). The screw (and, if attached, quick assembly component or bracket (142*a*, 142*b*, 142*c*, 142*d*, 142*e*, 142*f*, 142*g*)) can then be slid to the location on the frame 12 where the bracket is to be secured. The arrow in FIG. 3D illustrates the contemplated movement of the screws (30) in the grooves (12). Hence, the grooves function as tracks in which the quick assembly connectors can translate.

FIG. 4 presents a three-dimensional schematic diagram illustrating the assembly of multiple prefabricated wall panels, multiple prefabricated roof panels, multiple prefabricated floor panels, the frames, and multiple quick assembly connectors. To clearly demonstrate the internal structure of the quick assembly and disassembly shed (100), the panels (20) of these prefabricated wall panels (110) and prefabricated floor panels (130) are not depicted in FIG. 4. FIGS. 2 and 3 show the complete panel structure. The frame (10) of these prefabricated wall panels (110), prefabricated roof panels (120), and prefabricated floor panels (130) is securely connected with the quick assembly connectors (140*a*, 140*b*, 140*c*, 140*d*, 140*e*, 140*f*, 140*g*). The specific placement positions of these quick assembly connectors (140*a*, 140*b*, 140*c*, 140*d*, 140*e*, 140*f*, 140*g*) is not limited to the placement depicted in FIG. 4. The detailed placement positions of these quick assembly connectors (140*a*, 140*b*, 140*c*, 140*d*, 140*e*, 140*f*, 140*g*) will be individually explained.

FIG. 5A exhibits a partially enlarged view of region A from another angle in FIG. 4. FIG. 5B presents an exploded view of FIG. 5A. FIG. 5C showcases a three-dimensional schematic diagram demonstrating the assembly of the frame, quick assembly connectors, and screws after the assembly illustrated in FIG. 5B.

Referring to FIGS. 5A to 5C, the present invention includes a quick assembly connector system (140*a*) designed for connecting prefabricated wall panels (110) to frames (10). The quick assembly connector (140*a*) facilitates the connection of the lower edge (114) of two adjacent wall panels (110) to the two frames (10). The frames (10) are equipped with at least two grooves (12) to accommodate the connector. The grooves (12) comprise a C-shaped channel with a slotted opening facing outward on one side as shown in more detail in FIG. 9. The grooves (12) are preferably open at their axial ends so as to permit the quick assembly connector (140*a*) to be attached. In an embodiment discussed in more detail below, grooves on at least the inner (rear) facing side of frame 10 may include a hole in the slotted opening for inserting the head of a screw 30. The hole is positioned inward from the end of the frame 10.

The quick assembly connector (140*a*) comprises a quick assembly bracket (142*a*), two screws (30), and two nuts (40). In the illustrated embodiment the quick assembly component or bracket (142*a*) is a bracket, angle, or V or L shaped flange or framing member. In other embodiments discussed below the quick assembly bracket (142) may be U-shaped or a flat plate. The quick assembly bracket (142*a*) is provided with at least two holes (144) for accommodating the screws (30). In the illustrated embodiment one hole is in each leg of the component. Each screw (30) includes a screw or bolt head (32) and a shaft (34). The screw head (32) is sized to fit within the channel of the groove, but is sufficiently large so that it cannot pass through the slotted opening. During pre-assembly of the quick assembly connector (140*a*), the screw shafts (34) of the screws (30) are inserted through the holes (144) of the quick assembly bracket (142*a*) such that the screw head (32) is on one side of the quick assembly bracket. One screw head (32) is slid into the C-shaped channel of the groove (12) at the end of one of the frames (10) and the other screw head is slid into the groove (12) at the end of the other frame (10). The protruding screw shafts (34) extend through the holes (144) of the quick assembly bracket (142*a*), as shown in FIG. 5C. Finally, the nuts (40) are threaded onto the screw shafts (34), firmly pressing the quick assembly bracket (142*a*) against the frames (10).

FIG. 6A presents an enlarged view of region B in FIG. 4, while FIG. 6B shows an enlarged view of region C in FIG. 4. In this embodiment, the invention includes a quick assembly connector (140*b*) positioned on the two adjacent outer frames (10) of the pre-assembled wall panels (110) at the corner. In this embodiment the quick assembly bracket (142*b*) is an L-shaped bracket with each leg having a notch that is configured to accommodate the shaft (34) of the screw 30. The head (32) of the screw (30) is slid into the channel of the groove (12) at the end of each frame (10) of the adjacent wall panels (110). The nuts 40 are threaded on the shafts (34) securing the quick assembly bracket (142*b*) to each frame. Additionally, a quick assembly connector (140*c*), which includes a flat quick assembly bracket (142*c*) is placed on the two adjacent and aligned outer frames (10) of the pre-assembled roof panels (120) and secured in a manner as described above. A quick assembly connector (140*d*), which includes an angled quick assembly bracket (142*d*) with an angle that corresponds to the inner angle of the peak of the roof is positioned on the two abutting outer frames (10) of the pre-assembled roof panels (120) as shown. The quick assembly connector (140*d*) in a similar manner as described above with the screw heads inserted into the ends of each abutting outer frame.

FIG. 7A provides an enlarged view of region D in FIG. 4, while FIG. 7B presents an enlarged view of region E in FIG. 4 from another perspective. As shown in FIGS. 7A and 7B, the quick assembly connector (140*e*) (with its T-shaped plate for the quick assembly bracket (142*e*)) is placed on the three adjacent and aligned outer frames (10) of the pre-assembled wall panels (110) and one pre-assembled roof panel (120). Furthermore, a quick assembly connector (140*f*) (with its L-shaped bracket for the quick assembly bracket (142*f*)) is positioned on the three adjacent outer frames (10) of the pre-assembled wall panels (110) and pre-assembled roof panels (120). The three outer frames (10) include three grooves (12). The quick assembly connectors (140*e*) and (140*f*) include a quick assembly bracket (142*e*, 142*f*), three screws (30), and three nuts (40). The quick assembly brackets (142*e*, 142*f*) are each equipped with at least three holes (144). Each screw (30) comprises a screw head (32) and a screw shaft (34). The screw heads (32) slide into the three grooves (12) at the endo of the outer frames (10), while the screw shafts (34) protrude from slotted openings in the grooves in the outer frames (10) and extend through the holes (144) of the quick assembly brackets (142*e*, 142*f*). Finally, the three nuts (40) are threaded onto the screw shafts (34), securing the quick assembly brackets (142*e*, 142*f*) tightly against the three outer frames (10).

FIG. 8A depicts an enlarged perspective view of region F in FIG. 4, while FIG. 8B presents a three-dimensional schematic diagram based on FIG. 8A. In accordance with these figures, the present invention introduces a quick assembly connector (140*g*) comprising a U-shaped fixture (145) (which corresponds to the quick assembly bracket). The U-shaped fixture (145) securely fastens the two adjacent outer frames (10) of the two pre-assembled wall panels (110) that are positioned in close proximity and alignment. These outer frames (10) are each equipped with a groove (12) to accommodate the screws of the quick assembly connector (140*g*). The U-shaped fixture (145) comprises a central or middle section (146) and two side sections (147) that are connected to (formed integral with) the central section (146) preferably at right angles to the center section. Notably, the side sections (147) feature two notches (148) that are recessed inwards from an end of the side sections located away from the central section (146) and extend towards the central section (146).

To assemble the quick assembly connector (140*g*), two screws (30) and two nuts (40) are employed. Each screw (30) consists of a screw head (32) and a screw shaft (34). The screw heads (32) are slid into the ends of the grooves (12) of the outer frames (10), while the screw shaft (34) extends outward from the slotted opening of the groove of the outer frames (10) and through the notches (148) of the side sections (147). Subsequently, the two nuts (40) are securely fastened onto the screw shaft (34), exerting pressure on the side sections (147) and firmly pressing them against the two outer frames (10). This configuration ensures the stable connection of the quick assembly connector (140*g*) and the outer frames (10) of the pre-assembled wall panels (110).

In one embodiment, the present invention includes a U-shaped fixture (145) for attached panels that are arranged side to side, wherein the distance between the ends of the two side sections (or legs) (147) of the U-shaped fixture is less than the length of the central section (146). This is configured so that the side sections (147) must be flexed in order to clip onto the two aligned frames (as shown in FIGS. 8A, 8B and 9). This results in the U-shaped fixture (145) effectively and securely holding and stabilizing the two frames (10) of adjacent prefabricated wall panels (110), prefabricated roof panels (120), and prefabricated floor panels (130) while the fasteners are being tightened. Consequently, only one person is needed to handle the installation since the clip holds itself on the two adjacent frames and secures the frames together during the installation, significantly enhances the overall convenience of rapid assembly or disassembly and substantially improves the efficiency of the assembly process.

FIG. 9 depicts a sectional view along the A-A line of FIG. 8A of two adjacent and parallelly (linearly) arranged frames of prefabricated wall panels as shown in FIG. 8A. In FIG. 9, a waterproof flexible component or insert (150), such as silicone or rubber insert similar to weather stripping, is inserted between the two frames (10) of the adjacent prefabricated wall panels (110). Specifically, the frames (10) include two facing grooves (12). The waterproof flexible component (150) is inserted into the grooves (12). Thus, the quick assembly and disassembly shed (100) shown in FIG. 2 gains essential waterproof, moisture-resistant, and insect-proof properties for adjacent panels. In alternative embodiments, the waterproof flexible component (150) can also be placed between the two frames (10) of adjacent and parallelly (linearly) arranged prefabricated roof panels (120), between the two frames (10) of adjacent and parallelly (linearly) arranged prefabricated floor panels (130), and between the two frames (10) of adjacent prefabricated wall panels (110) and prefabricated floor panels (130). FIG. 9 shows a preferred frame configuration that can be used for some or all of the prefabricated roof panels (120), prefabricated floor panels (130), and prefabricated wall panels (110). The frame (10) is preferably square or rectangular and has a groove (12) formed on at least two frame walls and which extends to the axial end of the frame where it is open. As shown the C-shaped channel (12A) of the groove (12) captures the screw head (32) and the narrow slotted opening (12B) allows the screw shaft (34) to pass outward.

FIG. 10A presents a three-dimensional schematic diagram of another embodiment of the present invention, while FIG. 10B illustrates a sectional assembly schematic diagram of FIG. 10A.

As depicted in FIGS. 2 and 10A, users have the flexibility to assemble the quick assembly and disassembly shed (100) in various sizes according to specific site dimensions or usage requirements.

Referring to FIG. 1 and FIG. 10B, the prefabricated wall panels (110), prefabricated roof panels (120), and prefabricated floor panels (130) can be pre-assembled into segmented semi-finished products (170) possessing sufficient structural support strength utilizing the quick assembly connectors (140*a*, 140*b*, 140*c*, 140*d*, 140*e*, 140*f*, 140*g*). Once the segmented semi-finished products (170) are formed, users can subsequently assemble them to create the entire disassembly shed (100) as depicted in FIG. 10A.

FIG. 11 is an exploded schematic diagram of another embodiment of the quick assembly and disassembly shed according to the present invention. In this embodiment, the difference between the quick assembly and disassembly shed (100*a*) and the quick assembly and disassembly shed (100) lies in the shape of the roof. Only the differences will be explained below.

The quick assembly and disassembly shed (100*a*) includes multiple prefabricated wall panels (110), multiple prefabricated roof panels (120), multiple prefabricated floor panels (130), and multiple quick assembly connectors (140*a*, 140*b*, 140*c*, 140*d*, 140*e*, 140*f*, 140*g*). These prefabricated roof panels (120) can be detachably assembled to the upper edges (112) of the prefabricated wall panels (110) or docked with the prefabricated roof panels (120) to form a barn-style roof.

FIG. 12 is a three-dimensional schematic diagram of a prefabricated roof, multiple wall surfaces, and a ground surface composed of prefabricated roof panels, prefabricated wall panels, and prefabricated floor panels of the quick assembly and disassembly modular shed shown in FIG. 11. FIG. 13 is a three-dimensional schematic diagram of the quick assembly and disassembly modular shed shown in FIG. 11, assembled in a modular configuration. FIG. 14 is a three-dimensional schematic diagram of the completed assembly of the quick assembly and disassembly modular shed shown in FIG. 11.

Referring to FIGS. 12 to 14, when assembling the quick assembly and disassembly shed (100*a*), the prefabricated wall panels (110), prefabricated roof panels (120), and prefabricated floor panels (130) can be assembled first to form the roof, multiple wall surfaces, and ground surface as shown in FIG. 12, or they can be preassembled as segmented semi-finished modular components (170*a*) as shown in FIG. 13, and finally assembled into the quick assembly and disassembly modular shed (100*a*) as shown in FIG. 14.

FIG. 15 illustrates an exploded view of another embodiment of the quick assembly and disassembly modular shed according to the present invention. In this embodiment, the difference between the quick assembly and disassembly modular shed (100*b*) and the quick assembly and disassembly modular shed (100) lies in the shape of the roof. Only the differences will be described below.

Referring to FIG. 15, the quick assembly and disassembly modular shed (100*b*) comprises multiple prefabricated wall panels (110), multiple prefabricated roof panels (120), multiple prefabricated floor panels (130), and multiple quick assembly connectors (140*a*, 140*b*, 140*e*, 140*g*). These prefabricated roof panels (120) can be detachably assembled to the upper edge (112) of these prefabricated wall panels (110). Additionally, these prefabricated roof panels (120) are assembled into a flat plane and inclined in the same direction to form a single-slope roof.

In this embodiment, these prefabricated roof panels (120) are inclined downward from a direction away from the prefabricated wall panels (110*b*) towards the direction close to the prefabricated wall panels (110*b*), but the direction of inclination is not limited to this.

FIG. 16 presents a three-dimensional schematic diagram of the prefabricated roof panels, prefabricated wall panels, and prefabricated floor panels of the quick assembly and disassembly modular shed shown in FIG. 15, assembled to form the roof, multiple wall surfaces, and ground surface. FIG. 17 exhibits a three-dimensional schematic diagram of the completed assembly of the quick assembly and disassembly modular shed shown in FIG. 15.

Referring to FIG. 16, the prefabricated wall panels (110), prefabricated roof panels (120), and prefabricated floor panels (130) are first assembled to form the roof, multiple wall surfaces, and ground surface, and finally assembled into the quick assembly and disassembly modular shed 100*b* as shown in FIG. 17.

In summary, the present invention provides a quick assembly and disassembly modular shed comprising prefabricated wall panels (110), prefabricated roof panels (120), and optional prefabricated floor panels (130). These components are securely fixed using quick assembly connectors (140*a*, 140*b*, 140*e*, 140*g*). The prefabricated design enhances assembly and disassembly efficiency while preventing panel interference. Moreover, the quick assembly and disassembly modular shed offers high dimensional flexibility by utilizing prefabricated wall panels, prefabricated roof panels, and prefabricated floor panels of different width sizes, allowing users to customize the structure based on site or usage requirements. Various quick connection components enable the quick fixation of adjacent outer frames of the prefabricated wall panels, prefabricated roof panels, and prefabricated floor panels, empowering users to independently complete the installation process.

Figure 18A:
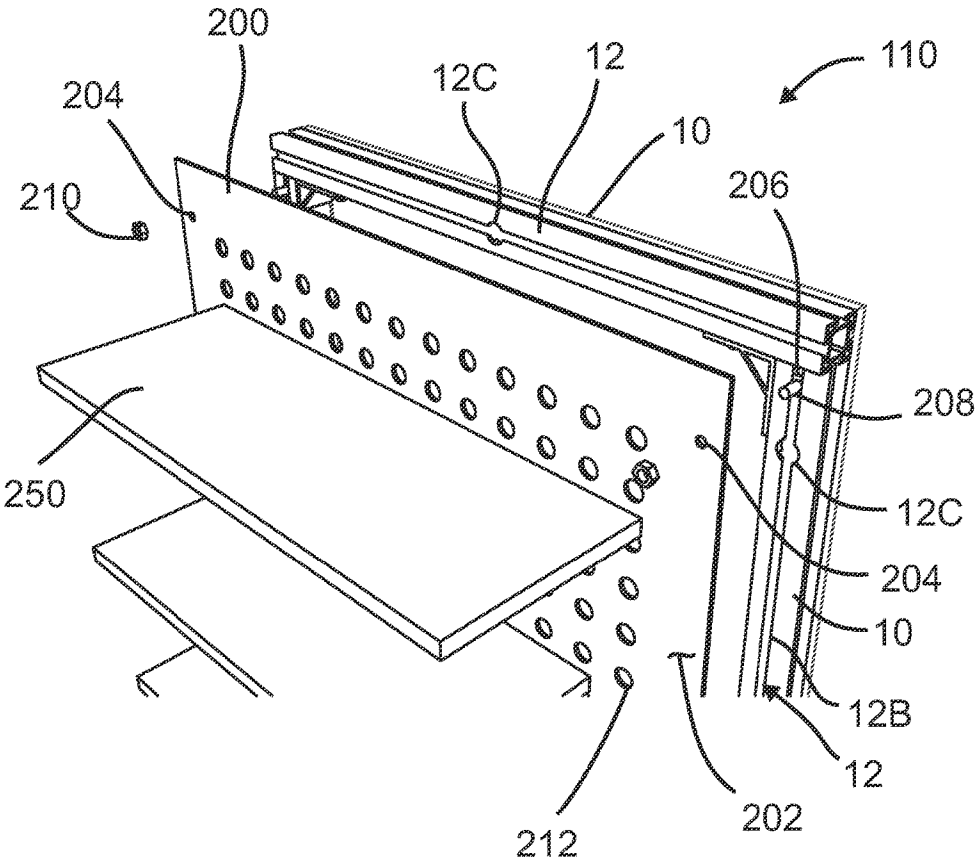
FIG. 18A is an enlarged portion of the outer frame of FIG. 18.
Figure 18:
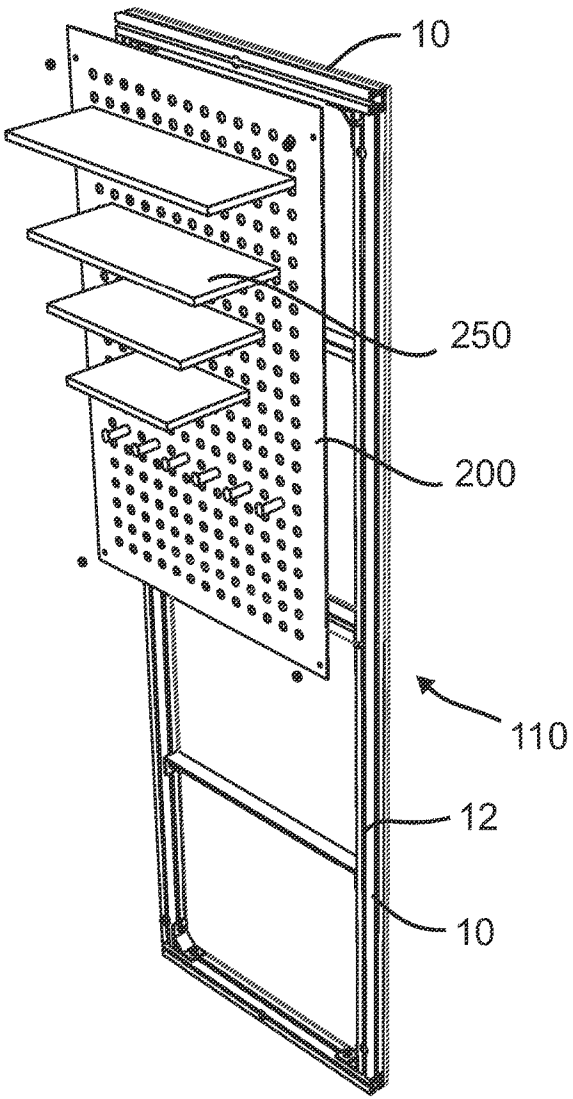
FIG. 18 illustrates a rear view of the outer frame of a wall panel according to an embodiment of the present invention showing the mounting of a utility panel and shelves to the rear (inside facing side) of the wall panel.
Figure 19A:
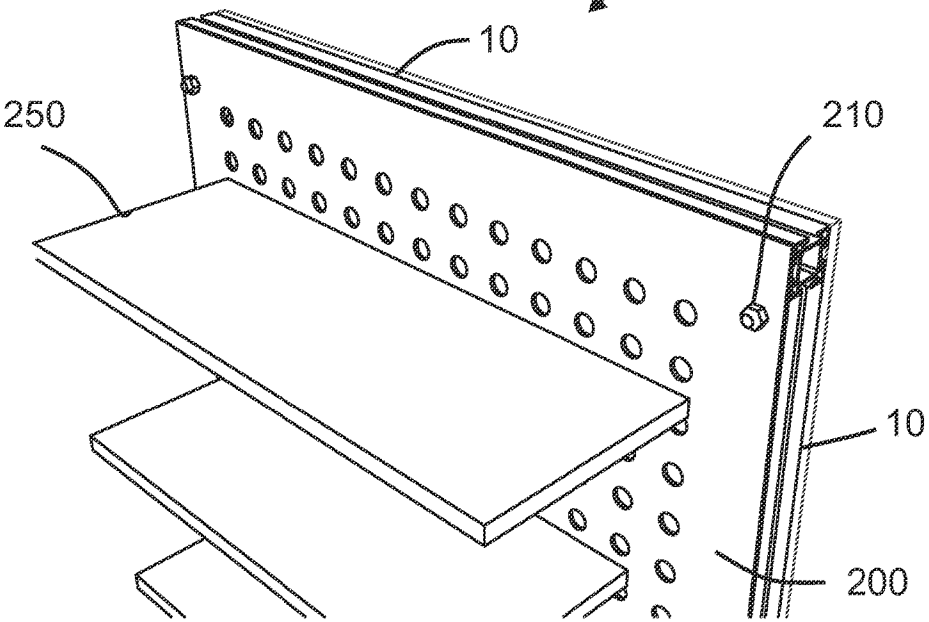
FIG. 19A is an enlarged portion of the outer frame of FIG. 19.
Figure 19:
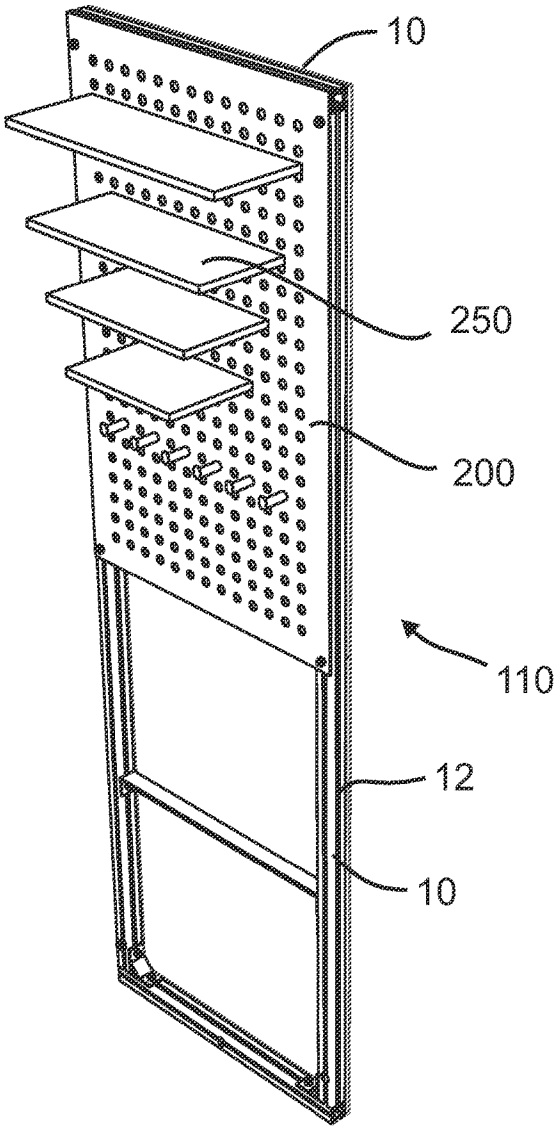
FIG. 19 illustrates a rear view of the outer frame of FIG. 18 illustrating the utility panel and shelves mounted to the rear (inside facing side) of the wall panel.

FIG. 18 illustrates a rear view of the outer frame of a wall panel (110) according to an embodiment of the present invention showing the mounting of optional accessories, such as a utility panel (200) and shelves (250) to the rear (inside) of the wall panel (110). FIG. 18A shows an enlarged portion of the outer frame of FIG. 18. The utility panel (200) includes a wall board or plate (202) that includes one or more mounting holes (204). The mounting holes (204) are located so as to align with the slotted openings (12B) of the frames (10). A mounting screw (206), similar to screw (30) is inserted into the groove (12) in the same manner as the attachment of the screw (30) of the quick assembly connectors (140*a*, 140*b*, 140*c*, 140*d*, 140*e*, 140*f*, 140*g*). The shaft (208) extends out of the slotted opening (12B) and through the mounting hole (204). A bolt (210) is threaded onto the shaft (208) thereby securing the board (202) to the frame (10). The wall board (202) may include a plurality of utility holes (212) for attachment of shelves (250), hooks, or other conventional items that may be mounted to a utility panel in a shed. FIG. 19 illustrates a rear view of the outer frame of FIG. 18 with the utility panel and shelves mounted to the rear (inside) of the wall panel. FIG. 19A is an enlarged portion of the outer frame of FIG. 19.

Other utility items may be attached to the grooves on the outer frames using one or more quick assembly connectors or other devices.

It is also contemplated that, if desired, insulation could be added to the rear facing (inside) of the wall and roof panels. Interior walls could then be attached, similar to the utility panel to provide inner wall surfaces for containing the insulation.

It is further contemplated that if the outer facing surface of any outer frame 10 includes a groove 12, a cover strip could be attached that covers the groove. The cover strip would have a generally flat surface that lies against the outer facing surface of the frame and covers the slotted opening with a center attachment leg extending at right angles to the flat surface and sized to fit into and frictionally engage the slotted opening for removably securing the cover strip to the outer frame. The cover strip could be made from any suitable material, such as plastic, silicone or rubber.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The particular implementations shown and described herein are illustrative examples of the invention and are not intended to otherwise limit the scope of the invention in any way. The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those skilled in this art without departing from the spirit and scope of the invention.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

Terms such as "about" or "approximately", unless otherwise defined or restricted in the specification, should be understood to define a variance of plus or minus 5%-10% to the numerical term referred to.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed. The various embodiments and elements can be interchanged or combined in any suitable manner as necessary.

The use of directions, such as forward, rearward, top and bottom, upper and lower are with reference to the embodiments shown in the drawings and, thus, should not be taken as restrictive. Reversing or flipping the embodiments in the drawings would, of course, result in consistent reversal or flipping of the terminology.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalent

The invention claimed is:

1. A quick assembled and disassembled shed assembly comprising:

a plurality of preassembled wall panels and roof panels, each pre-assembled wall panel and roof panel having an outer facing side and an inner facing side, each preassembled wall panel including:

a frame assembly formed by a plurality of outer frames, one outer frame of the plurality of outer frames is located on each side of the corresponding wall panel, each outer frame being attached to an adjacent outer frame of the corresponding wall panel, the attached outer frames defining the frame assembly, each outer frame including at least three sidewalls with at least two of the sidewalls each including a groove extending longitudinally along at least a portion of the sidewall, the groove including a channel formed inside the outer frame and a slot formed in the sidewall and providing access to the channel from outside the sidewall, and a wall panel member attached to at least two outer frames of the frame assembly to form the outer facing side of the preassembled wall panel;

each preassembled roof panel including:

two spaced apart outer frames defining the sides of the roof panel, each outer frame including at least three sidewalls with at least two of the sidewalls each including a groove extending longitudinally along at least a portion of the sidewall, the groove including a channel formed inside the outer frame and a slot formed in the sidewall and providing access to the channel from outside the sidewall, and a roof panel member attached to the two outer frames to form the outer facing side of the preassembled roof panel; and a plurality of quick assembly connectors, each quick assembly connector configured to attach one of the outer frames of the preassembled wall panel or roof panel to one of the outer frames of an adjacent preassembled wall panel or a roof panel, each quick assembly connector including:

a quick assembly bracket, at least two screws, each screw having a screw head attached to a screw shaft, the screw shaft having threads, and at least two nuts, each nut including threads that are configured to engage with the threads on the screw shaft, wherein the quick assembly bracket has at least two holes formed in it, each hole sized to receive the screw shaft of one of the at least two screws, such that the screw head is located on one side the quick assembly bracket and the threaded end of the screw shaft is located on the other side;

wherein the screw head is sized to fit and slide within the channel of the groove and the screw shaft is sized to fit within and slide along the slot in the sidewall, wherein adjacent preassembled wall panels and/or roof panels are attached to one another by inserting the screw head of one of the at least two screws in the channel of one of the outer frames of the preassembled wall panels and/or roof panels and inserting the screw head of another of the at least two screws in the channel of one of the outer frames of the adjacent preassembled wall panels and/or roof panels, inserting the screw shafts through the holes in the quick assembly bracket, and tightening the bolts onto the screw shafts.

2. The shed assembly according to claim 1, further comprising multiple preassembled floor panels, wherein each preassembled floor panel includes a frame assembly formed by a plurality of outer frames, one outer frame on each side of the floor panel, each outer frame being attached to an adjacent outer frame of the floor panel to define the frame assembly, each outer frame including at least three sidewalls with at least two of the sidewalls each including a groove extending along at least a portion of the sidewall, the groove including a channel formed inside the outer frame and a slot formed in the sidewall and providing access to the channel from outside the sidewall.

3. The shed assembly according to claim 2, wherein the grooves in the outer frames of the pre-assembled wall panels, roof panels and floor panels extend from one axial end of the outer frame to its other end and wherein the groove is open at each axial end of the frame.

4. The shed assembly according to claim 2, wherein pre-assembled wall panels have the same or different width and height dimensions, wherein the pre-assembled roof panels have the same or different width and height dimensions, and wherein pre-assembled floor panels have the same or different width and height dimensions.

5. The shed assembly according to claim 2, wherein at least one of the quick assembly connectors is configured to connect with the grooves formed in the outer frames of any three adjacent pre-assembled wall panels, roof panels, or floor panels, the quick assembly bracket having three holes and three screws, and wherein a portion of the quick assembly bracket overlaps the outer frame on each of the three adjacent pre-assembled wall panels, roof panels, or floor panels such that one of the holes in the quick assembly bracket is aligned with a corresponding groove on each of the outer frames, and wherein each of the screws is engaged with each of the holes such that the screw head of each screw is located in the channel of the corresponding groove.

6. The shed assembly according to claim 5, wherein the quick assembly bracket of at least one of the quick assembly connectors is a U-shaped fixture with a middle section and two side sections that are connected to the middle section, the side sections are at substantially right angles to the center section, each side section includes a notched opening on its end for receiving a screw, wherein at least a portion of the side sections are spaced apart from one other by a distance that is less than the width of two adjacent outer frames of two adjacent pre-assembled wall panels, roof panels and floor panels, such that the two side sections must be bent to clip the U-shaped fixture onto the two adjacent outer frames.

7. The shed assembly according to claim 6, wherein the notches of each side section of the U-shaped fixture extend along the side section a sufficient distance so that when the u-shaped fixture is clipped onto the two adjacent outer frames, the notches permit a screw to be inserted into a corresponding groove on a sidewall of each outer frame.

8. The shed assembly according to claim 2, further comprising a plurality of flexible waterproof inserts, at least one of the inserts configured to be installed between each set of adjacent prefabricated wall panels, adjacent prefabricated roof panels, and adjacent prefabricated floor panels, and wherein the insert is configured to engage with the slot in at least one of the outer frames of the adjacent prefabricated wall panels, adjacent prefabricated roof panels, and adjacent prefabricated floor panels.

9. The shed assembly according to claim 8, wherein the waterproof insert engages with one slot on each of the adjacent outer frames.

10. The shed assembly according to claim 2, further comprising a joint cap that is configured to attach to and overlap top edges of two abutting preassembled roof panels, the joint cap having an inverted V-shape, and wherein the quick assembly bracket of at least one of the quick assembly connectors has an inverted V-shape and wherein the holes in the bracket are located so as to align with the slots in two abutting outer frames of the preassembled roof panels.

11. The shed assembly according to claim 2, further comprising at least one door constructed the same as one of the plurality of prefabricated wall panels, the at least one door configured to be attached to one of the plurality of prefabricated wall panels by at least one hinge so that when attached the door rotates relative to the prefabricated wall panel to which it is attached.

12. The shed assembly according to claim 2, wherein the grooves in the outer frames include at least one hole formed in the slot in the sidewall with a diameter larger than the diameter of the head of the screws thereby permitting the head of the screw to be inserted into the channel through the hole in the slot.

13. A quick assembled and disassembled shed assembly comprising:

a plurality of preassembled wall panels, each pre-assembled wall panel having an outer facing side and an inner facing side, each preassembled wall panel including:

a frame assembly formed by a plurality of outer frames, one outer frame of the plurality of outer frames is located on each side of the corresponding wall panel, each outer frame being attached to an adjacent outer frame of the corresponding wall panel, the attached outer frames defining the frame assembly, each outer frame including at least three sidewalls with at least two of the sidewalls each including a groove extending longitudinally along at least a portion of the sidewall, the groove including a channel formed inside the outer frame and a slot formed in the sidewall and providing access to the channel from outside the sidewall, and a wall panel member attached to at least two of the outer frames of the frame assembly to form the outer facing side of the preassembled wall panel;

a plurality of preassembled roof panels, each pre-assembled roof panel having an outer facing side and an inner facing side, each preassembled roof panel including:

two spaced apart outer frames defining the sides of the roof panel, each outer frame including at least three sidewalls with at least two of the sidewalls each including a groove extending longitudinally along at least a portion of the sidewall, the groove including a channel formed inside the outer frame and a slot formed in the sidewall and providing access to the channel from outside the sidewall, and a roof panel member attached to the two outer frames to form the outer facing side of the preassembled roof panel;

a plurality of preassembled floor panels, each pre-assembled floor panel having an outer facing side and an inner facing side, each preassembled floor panel including:

a frame assembly formed by a plurality of outer frames, one outer frame on each side of the floor panel, each outer frame being attached to an adjacent outer frame of the floor panel to define the frame assembly, each outer frame including four sidewalls with at least two of the sidewalls each including a groove extending along at least a portion of the sidewall, the groove including a channel formed inside the outer frame and a slot formed in the sidewall and providing access to the channel from outside the sidewall, a floor panel member attached to at least two of the outer frames of the floor frame assembly to form the inner facing side of the preassembled floor panel;

a plurality of quick assembly connectors, each quick assembly connector including:

a quick assembly bracket with at least two holes formed through it, at least two screws, each screw having a screw head attached to a screw shaft, the screw shaft having threads, and at least two nuts, each nut including threads that are configured to engage with the threads on the screw shaft, wherein when assembled the screw shaft of each of the screws is located in a corresponding hole of the bracket such that the head of the screws are on one side of the bracket and the screw shaft threads are on the other side of the bracket, and each nut is threaded onto an associated one of the screw shafts;

wherein at least one quick assembly connector of the quick assembly connectors is configured to attach adjacent preassembled wall panels with the head of one of the screws located in the channel of the outer frame of one of the preassembled wall panels and the head of the other of the screws located in the channel of the outer frame of the adjacent preassembled wall panel;

wherein at least one quick assembly connector of the quick assembly connectors is configured to attach one of the preassembled wall panels to an adjacent preassembled roof panel with the head of one of the screws located in the channel of the outer frame of the preassembled wall panel and the head of the other of the screws located in the channel of the outer frame of the preassembled roof panel; and wherein at least one quick assembly connector of the quick assembly connectors is configured to attach one of the preassembled wall panels to an adjacent preassembled floor panel with the head of one of the screws located in the channel of one of the outer frames of the preassembled wall panel and the head of the other of the screws located in the channel of one of the outer frames of the preassembled floor panel.

14. The shed assembly according to claim 13, wherein the grooves in the outer frames of the pre-assembled wall panels, roof panels and floor panels extend from one axial end of the outer frame to its other end and wherein the groove is open at each axial end of the frame.

15. The shed assembly according to claim 13, wherein at least one of the quick assembly connectors is configured to connect with the grooves formed in the outer frames of any three adjacent pre-assembled wall panels, roof panels, or floor panels, the quick assembly bracket having three holes and three screws, and wherein a portion of the quick assembly bracket overlaps the outer frame on each of the three adjacent pre-assembled wall panels, roof panels, or floor panels such that one of the holes in the quick assembly bracket is aligned with a corresponding groove on each of the outer frames, and wherein each of the screws is engaged with each of the holes such that the screw head of each screw is located in the channel of the corresponding groove.

16. The shed assembly according to claim 13, wherein the quick assembly bracket of at least one of the quick assembly connectors is a U-shaped fixture with a middle section and two side sections that are connected to the middle section, the side sections are at substantially right angles to the center section, each side section includes a notched opening on its end for receiving a screw, wherein at least a portion of the side sections are spaced apart from one other by a distance that is less than the width of two adjacent outer frames of two adjacent pre-assembled wall panels, roof panels and floor panels, such that the two side sections must be bent to clip the U-shaped fixture onto the two adjacent outer frames.

17. The shed assembly according to claim 16, wherein the notches of each side section of the U-shaped fixture extend along the side section a sufficient distance so that when the u-shaped fixture is clipped onto the two adjacent outer frames, the notches permit a screw to be inserted into a corresponding groove on a sidewall of each outer frame.

18. The shed assembly according to claim 13, further comprising a plurality of flexible waterproof inserts, at least one of the inserts configured to be installed between each set of adjacent prefabricated wall panels, adjacent prefabricated roof panels, and adjacent prefabricated floor panels, and wherein the insert is configured to engage with the slot in at least one of the outer frames of the adjacent prefabricated wall panels, adjacent prefabricated roof panels, and adjacent prefabricated floor panels.

19. The shed assembly according to claim 18, wherein the waterproof insert engages with one slot on each of the adjacent outer frames.

20. The shed assembly according to claim 13, further comprising a joint cap that is configured to attach to and overlap top edges of two abutting preassembled roof panels, the joint cap having an inverted V-shape, and wherein the quick assembly bracket of at least one of the quick assembly connectors has an inverted V-shape and wherein the holes in the bracket are located so as to align with the slots in two abutting outer frames of the preassembled roof panels.

21. The shed assembly according to claim 13, further comprising at least one door constructed the same as one of the plurality of prefabricated wall panels, the at least one door configured to be attached to one of the plurality of prefabricated wall panels by at least one hinge so that when attached the door rotates relative to the prefabricated wall panel to which it is attached.

22. The shed assembly according to claim 13, wherein the grooves in the outer frames include at least one hole formed in the slot in the sidewall with a diameter larger than the diameter of the head of the screws thereby permitting the head of the screw to be inserted into the channel through the hole in the slot.

23. A method of assembling a quick assembled and disassembled shed of claim 2 comprising the steps of:

(a) placing a preassembled wall panel adjacent to one another preassembled wall panel;

(b) attaching the adjacent preassembled wall panels to one another by inserting the head of the screw of one of the quick assembly connectors into the channel of the groove in the outer frame of one of the preassembled wall panels, and the head of the other screw of the quick assembly connector into the channel of the groove in the outer frame of the adjacent preassembled wall panels, inserting the screw shafts through the holes in the quick assembly bracket of the quick assembly connector and threading the nuts onto the screw shafts to secure the quick assembly connector to the adjacent preassembled wall panels;

(c) repeating steps (a) and (b) for all the preassembled wall panels;

(d) placing a preassembled roof panel adjacent to a preassembled wall panel;

(e) attaching the adjacent preassembled roof panel and preassembled wall panels to one another by inserting the head of the screw of one of the quick assembly connectors into the channel of the groove in one of the outer frames of the preassembled roof panel, and the head of the other screw of the quick assembly connector into the channel of the groove in one of the outer frames of the adjacent preassembled wall panel, inserting the screw shafts of the screws through the holes in the quick assembly bracket and threading the nuts onto the screw shafts to secure the quick assembly bracket to the preassembled roof panel and the adjacent preassembled wall panel;

(f) repeating steps (d) and (e) for all the preassembled roof panels;

(g) placing a preassembled floor panel adjacent to a preassembled wall panel;

(h) attaching the adjacent preassembled floor panel and preassembled wall panels to one another by inserting the head of the screw of one of the quick assembly connectors into the channel of the groove in one of the outer frames of the preassembled floor panel, and the head of the other screw of the quick assembly connector into the channel of the groove in one of the outer frames of the adjacent preassembled wall panel, inserting the screw shafts of the screws through the holes in the quick assembly bracket and threading the nuts onto the screw shafts to secure the quick assembly bracket to the preassembled floor panel and the adjacent preassembled wall panel; and (i) repeating steps (g) and (h) for all the preassembled floor panels;

at least two screws, each screw having a screw head attached to a screw shaft, the screw shaft having threads, and at least two nuts, each nut including threads that are configured to engage with the threads on the screw shaft, wherein the quick assembly bracket has at least two holes formed in it, each hole sized to receive the screw shaft of one of the at least two screws, such that the screw head is located on one side the quick assembly bracket and the threaded end of the screw shaft is located on the other side;

wherein the screw head is sized to fit and slide within the channel of the groove and the screw shaft is sized to fit within and slide along the slot in the sidewall, wherein adjacent preassembled wall panels and/or roof panels are attached to one another by inserting the screw head of one of the at least two screws in the channel of one of the outer frames of the preassembled wall panels and/or roof panels and inserting the screw head of another of the at least two screws in the channel of one of the outer frames of the adjacent preassembled wall panels and/or roof panels, inserting the screw shafts through the holes in the quick assembly bracket, and tightening the bolts onto the screw shafts.

* * * * *